US009181689B2

(12) United States Patent
Imai et al.

(10) Patent No.: US 9,181,689 B2
(45) Date of Patent: Nov. 10, 2015

(54) TOILET APPARATUS

(75) Inventors: Shigeo Imai, Tokyo (JP); Toshihiro Nakamiya, Tokyo (JP); Tatsunori Murai, Tokyo (JP)

(73) Assignee: LIXIL CORPORATION, Koto-Ku, Tokyo (JP)

( * ) Notice: Subject to any disclaimer, the term of this patent is extended or adjusted under 35 U.S.C. 154(b) by 318 days.

(21) Appl. No.: 13/878,504

(22) PCT Filed: Oct. 21, 2011

(86) PCT No.: PCT/JP2011/074325

§ 371 (c)(1),
(2), (4) Date: Apr. 9, 2013

(87) PCT Pub. No.: WO2012/057034

PCT Pub. Date: May 3, 2012

(65) Prior Publication Data

US 2013/0191983 A1 Aug. 1, 2013

(30) Foreign Application Priority Data

| | | |
|---|---|---|
| Oct. 29, 2010 | (JP) | 2010-244436 |
| Mar. 15, 2011 | (JP) | 2011-057145 |
| Oct. 5, 2011 | (JP) | 2011-221318 |

(51) Int. Cl.

| | |
|---|---|
| ***E03D 1/00*** | (2006.01) |
| ***E03D 9/08*** | (2006.01) |
| ***E03D 5/012*** | (2006.01) |
| ***E03D 5/016*** | (2006.01) |

(52) U.S. Cl.

CPC .. *E03D 9/08* (2013.01); *E03D 1/00* (2013.01); *E03D 5/012* (2013.01); *E03D 5/016* (2013.01)

(58) Field of Classification Search

CPC ..... E03D 5/01
USPC ..... 4/300–442
See application file for complete search history.

(56) References Cited

FOREIGN PATENT DOCUMENTS

| | | | |
|---|---|---|---|
| CN | 1133379 | A | 10/1996 |
| CN | 2366463 | Y | 3/2000 |
| CN | 2680748 | | 2/2005 |
| CN | 1760483 | | 4/2006 |
| CN | 201087471 | | 7/2008 |
| JP | S58-181936 | A | 10/1983 |
| JP | 63-107632 | A | 5/1988 |
| JP | 64-66325 | A | 3/1989 |
| JP | 8-266443 | A | 10/1996 |
| JP | 9-165808 | A | 6/1997 |
| JP | 3118862 | U | 1/2006 |
| JP | 2006-138137 | A | 6/2006 |
| JP | 2010-138683 | A | 6/2010 |

*Primary Examiner* — Lori Baker
(74) *Attorney, Agent, or Firm* — Smith, Gambrell & Russell, LLP

(57) ABSTRACT

Providing a toilet apparatus which can reduce an amount of water discharged into a waste collection tub. The toilet apparatus includes a toilet body (10) equipped with a toilet bowl (11) having a drain outlet (11A) in its lower part, a discharge part (20) communicating between the drain outlet (11A) and a waste collection tub (90) located below the toilet body (10), a drainage channel (30) branched from the discharge part (20), and a private parts cleaning device (50) assembled to the toilet body (10) and having a cleaning nozzle (51). When the private parts cleaning device (50) is actuated and an amount of cleaning water ejected from the cleaning nozzle (51) equals or exceeds a set amount, the cleaning water flowing into the toilet bowl (11) is caused to flow into the drainage channel (30) without being discharged via the discharge part (20) into the waste collection tub (90).

21 Claims, 15 Drawing Sheets

TOILET APPARATUS

TECHNICAL FIELD

The present invention relates to a toilet apparatus.

BACKGROUND ART

Patent Document 1 discloses a conventional toilet apparatus. The disclosed toilet apparatus includes a toilet body provided with a toilet bowl having a drain outlet in a lower part thereof, a discharge part communicating the outlet to a waste collection tub located below the toilet body, a drainage channel branched off from the discharge part, a toilet flushing device supplying flush water to the toilet bowl and a detecting device which detects a user of the toilet body.

In this toilet apparatus, after the detecting device has ceased detecting the user, a small amount of flush water is firstly supplied into the toilet bowl by the toilet flushing device so that toilet paper or the like remaining in the toilet bowl is caused to flow into the waste collection tub with the flush water. A large amount of flush water is subsequently supplied into the toilet bowl to flush the toilet bowl. In this case, the flush water supplied into the toilet bowl is caused to flow into the drainage channel but not discharged through the discharge part into the waste collection tub. Accordingly, the toilet apparatus can prevent a large amount of flush water from being discharged into the waste collection tub.

Patent Document 2 discloses another conventional toilet apparatus. The disclosed toilet apparatus includes a toilet bowl, a waste collection tub, a discharge part and a closing tool. The waste collection tub is provided below the toilet bowl. The discharge part communicates between the toilet bowl and the waste collection tub. The discharge part can be opened and closed by the closing tool. More specifically, when a user is seated on a toilet seat provided above the toilet bowl, the resultant load causes the closing tool to open the discharge part. The closing tool closes the discharge part when the user departs from the toilet seat. The toilet apparatus includes a drainage channel from which is branched from the discharge part located above the closing tool. The drainage channel has a downstream end communicating with a purification processing device. An exhaust pipe is connected to the drainage channel. The exhaust pipe is provided with air exhaust equipment.

When the user departs from the toilet seat and the toilet is to be flushed, flush water discharged from the toilet flushing device flows through the drainage channel into a purification processing device since the discharge part is closed by the closing tool in the above-described toilet apparatus. Foul odor rising from the purification processing device is exhausted through the exhaust pipe provided in the middle of the drainage channel.

PRIOR ART DOCUMENT

Patent Documents

Patent Document 1: Japanese Utility Model Registration No. 3118862

Patent Document 2: Japanese Patent Application Publication No. JP-A-S58-181936

SUMMARY OF THE INVENTION

Problem to be Overcome by the Invention

In the toilet apparatus of Patent Document 1, however, the water which flows into the drainage channel without being discharged into the waste collection tub is only the flush water to flush the toilet bowl after the detecting device has ceased detecting the user. Accordingly, when a private parts cleaning device is incorporated in the toilet body, water or the like discharged from the private parts cleaning device is further discharged through the discharge part into the waste collection tub. Furthermore, flush water supplied from the toilet flushing device to the toilet bowl is also discharged through the discharge part to the waste collection tub.

Furthermore, the discharge part is opened by the closing tool in the toilet apparatus of Patent Document 2 when the user seats on the toilet seat. This results in foul odor rising from the waste collection tub. Accordingly, the user smells foul odor and the foul odor spreads from the toilet bowl into the toilet room. It is difficult to exhaust the foul odor through the exhaust pipe provided in the middle of the drainage channel.

First to third inventions were made in view of the actual condition described in Patent Document 1 and an object thereof is to provide a toilet apparatus which can reduce an amount of water discharged to the waste collection tub.

A fourth invention was made in view of the actual condition described in Patent Document 2 and an object thereof is to provide a toilet apparatus which can be used successfully with the user not almost feeling foul odor.

Means for Overcoming the Problem

A toilet apparatus according to a first invention comprises a toilet body provided with a toilet bowl having a drain outlet in a lower part thereof, a discharge part communicating between the drain outlet and a waste collection tub provided below the toilet body, a drainage channel branched off from the discharge part, and a private parts cleaning device assembled to the toilet body and having a cleaning nozzle. In the toilet apparatus, when the private parts cleaning device is actuated and an amount of cleaning water ejected from the cleaning nozzle equals or exceeds a set amount, the cleaning water flowing into the toilet bowl is caused to flow into the drainage channel without being discharged via the discharge part into the waste collection tub.

When the private parts cleaning device is actuated for execution of cleaning of private parts, waste adherent to buttocks of the user is washed away at an initial stage. Accordingly, cleaning water flowing into the toilet bowl has a relatively higher impurity degree at the initial state. In view of this, the private parts cleaning water is discharged via the discharge part into the waste collection tub. Subsequently, when the private parts cleaning device is continuously actuated, the private parts cleaning water which falls into the toilet bowl to flow into the drain outlet has a lower impurity degree. The private parts cleaning water is then caused to flow into the drainage channel without being discharged via the discharge part into the waste collection tub. Consequently, the toilet apparatus can reduce an amount of private parts cleaning water to be discharged into the waste collection tub.

A toilet apparatus according to a second invention comprises a toilet body provided with a toilet bowl having a drain outlet in a lower part thereof, a discharge part communicating between the drain outlet and a waste collection tub provided below the toilet body, a drainage channel branched off from the discharge part, and a private parts cleaning device assembled to the toilet body and having a cleaning nozzle and a nozzle cleaning mechanism. In the toilet apparatus, nozzle cleaning water having flowed into the toilet bowl is caused to flow into the drainage channel without being discharged via the discharge part into the waste collection tub, while the cleaning nozzle is being cleaned by the nozzle cleaning mechanism.

The nozzle cleaning water used to clean the cleaning nozzle and flowing into the drain outlet generally has a low impurity degree. Accordingly, the nozzle cleaning water is caused to flow into the drainage channel without being discharged through discharge part into the waste collection tub, with the result that the nozzle cleaning water can be prevented from being discharged into the waste collection tub. Consequently, the toilet apparatus can reduce an amount of water discharged into the waste collection tub.

A toilet apparatus according to a third invention comprises a toilet body provided with a toilet bowl having a drain outlet in a lower part thereof, a discharge part communicating between the drain outlet and a waste collection tub provided below the toilet body, a drainage channel branched off from the discharge part, and a toilet flushing device which executes cleaning flushing in which a set amount of flush water is supplied into the toilet bowl when the toilet body is cleaned. In the toilet apparatus, the flush water flowing into the toilet bowl is caused to flow into the drainage channel without being discharged via the discharge part into the waste collection tub, during execution of the cleaning flushing.

The flush water supplied into the toilet bowl for execution of cleaning flushing and flowing into the drain outlet generally has a low impurity degree. Accordingly, the flush water is caused to flow into the drainage channel without being discharged through the discharge part into the waste collection tub, with the result that the flush water supplied into the toilet bowl for execution of cleaning flushing can be prevented from being discharged into the waste collection tub. Consequently, the toilet apparatus can reduce an amount of water discharged into the waste collection tub. The toilet apparatus can further prevent the flush water containing a cleaning agent used in the cleaning flushing from being discharged into the waste collection tub.

Accordingly, the toilet apparatus according to the first, second or third invention can reduce an amount of water discharged into the waste collection tub.

A toilet apparatus according to a fourth invention comprises a toilet bowl, a discharge part communicating between the toilet bowl and a waste collection tub provided below the toilet bowl, a closing tool having a receiving member which receives egested waste and/or water flowing into the toilet bowl, the closing tool closing the discharge part when the waste and/or the water has fallen from the receiving member, an air flow path communicating with a vicinity of an upstream side with respect to the closing tool while the discharge part is closed by the closing tool, and a blower provided in the air flow path.

The discharge part is normally closed by the closing tool in the toilet apparatus. The blower is driven while the discharge part is closed by the closing tool in the toilet apparatus, with the result that air in a toilet can be discharged via the toilet bowl and the air flow path. More specifically, the toilet apparatus can discharge odor in the toilet. Furthermore, the toilet apparatus can also discharge via the air flow path odor emitted from waste or the like while receiving the waste or the like on the receiving member. Consequently, the user can hardly smell the odor emitted from the waste or the like (foul odor) and diffusion of the odor in the toilet can be suppressed. Furthermore, a time period in which the discharge part is kept open is short since the closing tool opens the discharge part when the weight of waste or the like received by the receiving member exceeds a set weight or when the waste or the like having fallen onto the receiving member is detected, and the closing tool closes the discharge part when the waste or the like has fallen from the receiving member. Accordingly, an amount of odor in the waste collection tub which rises above the closing tool is small. Thus, since an amount of odor rising above the closing tool from the waste collection tub is small, the odor can reliably be discharged by the blower provided in the air flow path. Furthermore, outside air can be supplied via the air flow path into the toilet bowl by driving the blower when the discharge part is opened by the closing tool. Air flow is caused from the discharge part toward the waste collection tub when the discharge part is temporarily opened by the closing tool. In this case, air supplied through the air flow path from outside by the driving of the blower is drawn into the waste collection tub, with the result that air in the toilet bowl is not drawn through the discharge part into the waste collection tub. Consequently, air can be prevented from flowing along peripheries of the buttocks of the user seated on the toilet seat provided over the upper surface of the toilet bowl, whereupon the user can be prevented from receiving coolness.

Accordingly, the user can use the toilet apparatus according to the fourth invention well while having less possibility of smelling foul odor.

MODE FOR CARRYING OUT THE INVENTION

Figure 1:
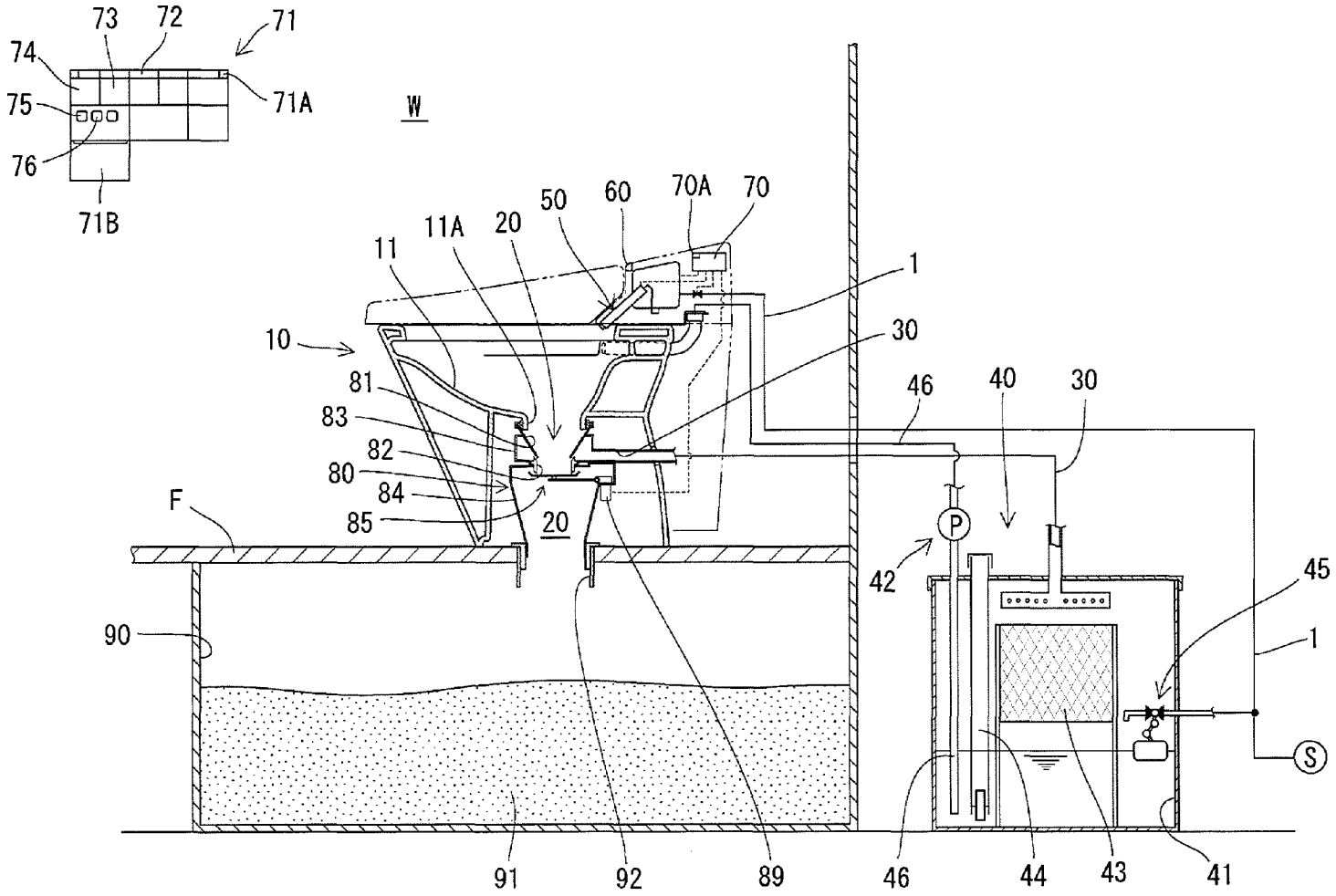
FIG. 1 is a schematic view of the toilet apparatus according to embodiments 1 and 2.
Figure 2:
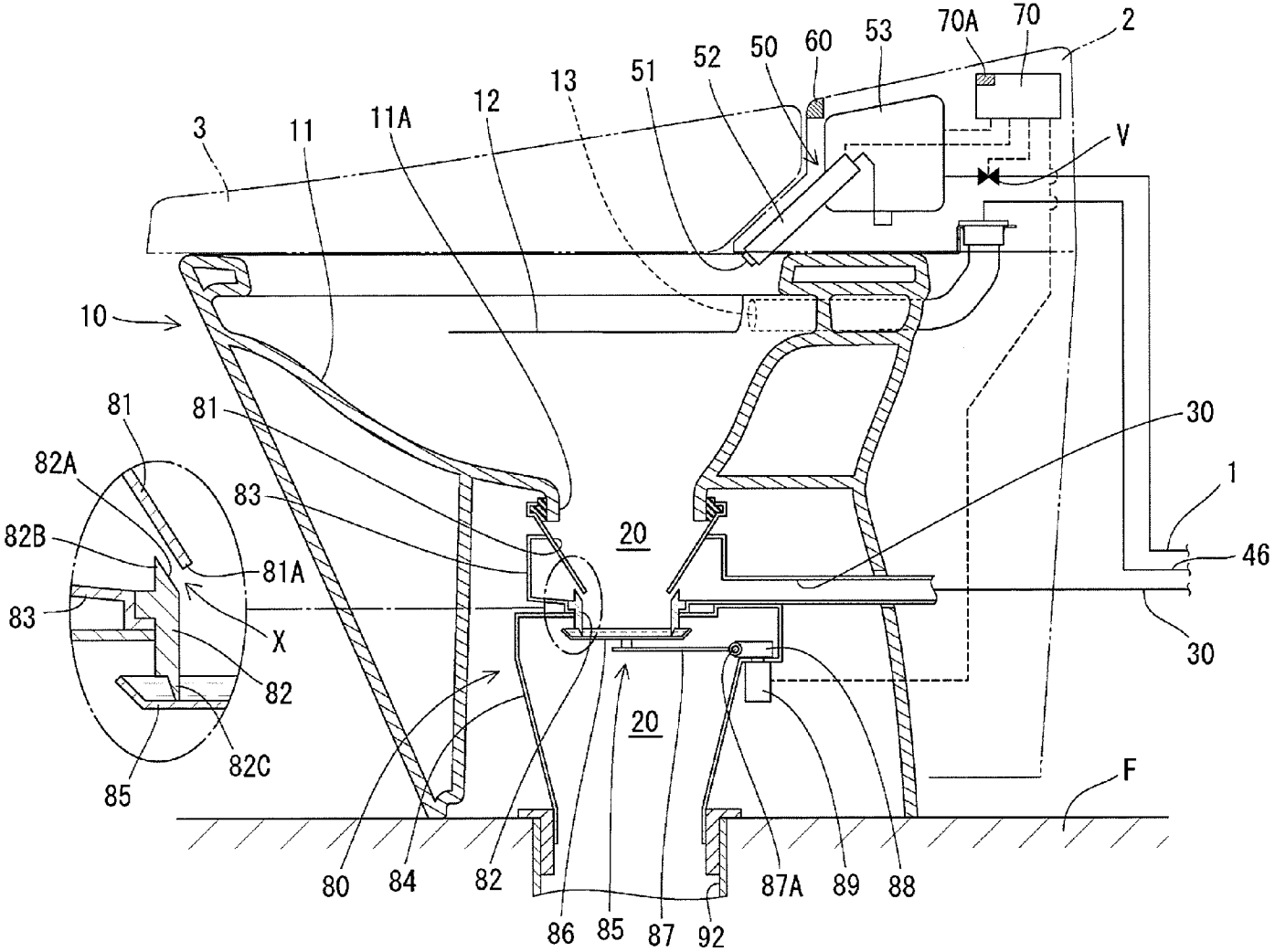
FIG. 2 is a schematic view of major components such as a toilet body of the toilet apparatus according to embodiments 1 and 2.
Figure 3:
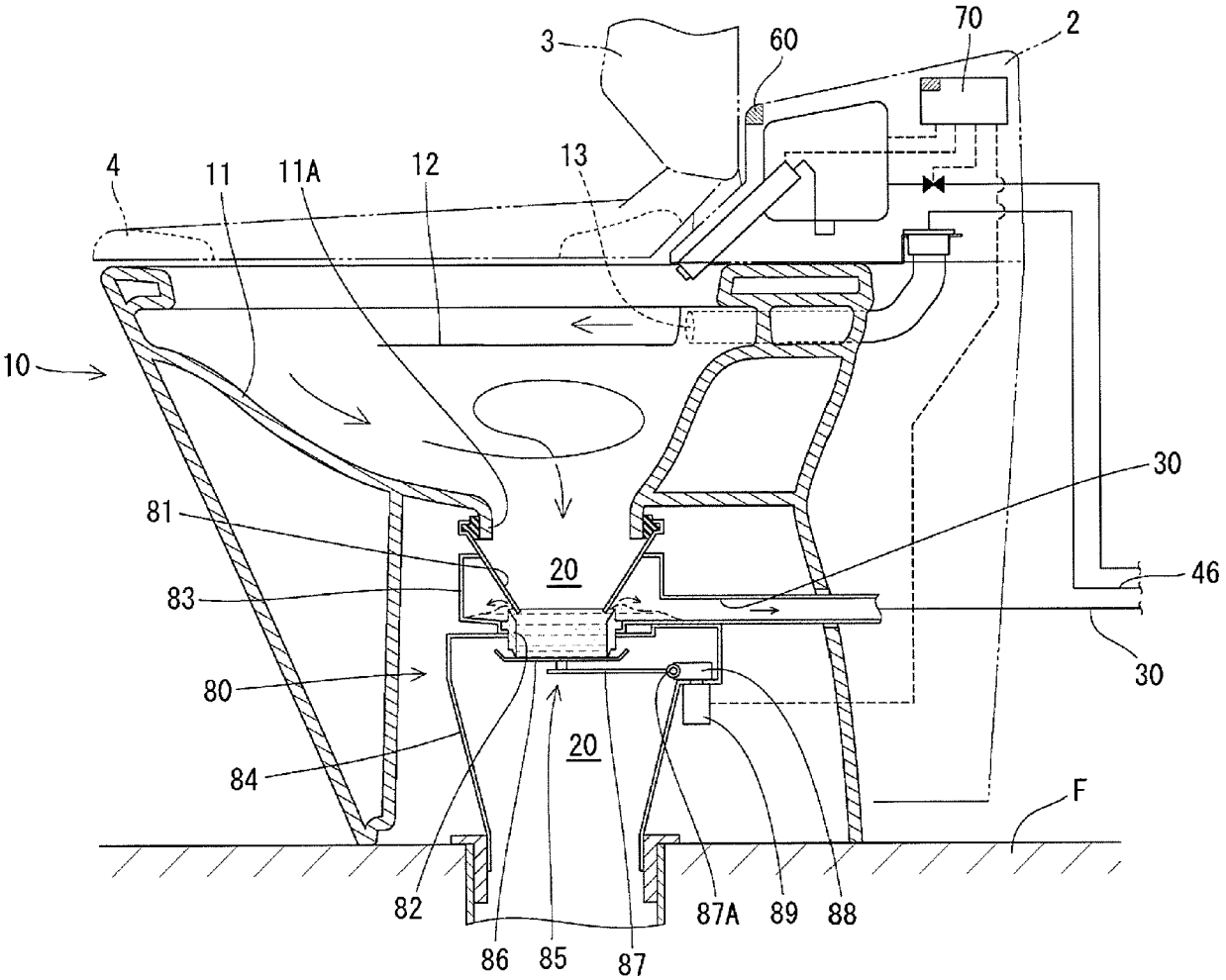
FIG. 3 is a schematic view of the toilet apparatus according to embodiments 1 and 2, showing execution of pre-flushing.

Preferred forms of the first invention, the second invention and the third invention will be described.

The toilet apparatus according to the first invention may further comprise a toilet flushing device supplying flush water into the toilet bowl, wherein when the private parts cleaning device is actuated and an amount of cleaning water ejected from the cleaning nozzle equals or exceeds the set amount, the toilet flushing device may be actuated before the cleaning water flowing into the toilet bowl is caused to flow into the drainage channel, so that a predetermined amount of flush water is supplied into the toilet bowl.

In this case, the toilet flushing device is actuated to supply the set amount of flush water into the toilet bowl before the private parts cleaning water having flowed into the toilet bowl is caused to flow into the drainage channel. Consequently, the private parts cleaning water having a high impurity degree in the toilet bowl can completely be discharged into the waste collection tub, whereupon the impurity degree of the private parts cleaning water flowing into the drainage channel can reliably be rendered lower.

The discharge part may be connected to the drain outlet in the toilet apparatus according to the first invention, and the apparatus may further comprise a connecting device including a closing tool which opens and closes the discharge part and a lock device which locks the closing tool in a closing state in which the discharge part is closed, the drainage channel being formed by branching the discharge part at an upstream side with respect to the closing tool, and a control device which activates the lock device so that the closing tool is locked in the closing state when the private parts cleaning device is actuated and the amount of cleaning water ejected from the cleaning nozzle equals or exceeds the set amount.

In this case, when the private parts cleaning device is actuated and an amount of private parts cleaning water ejected from the cleaning nozzle equals or exceeds the set amount, the closing tool is locked in the closing state. Consequently, the private parts cleaning water having the lower impurity degree can be caused to flow into the drainage channel. Furthermore, an amount of private parts cleaning water discharged into the waste collection tub can be reduced.

The toilet apparatus according to the first invention may further comprise a toilet flushing device supplying flush water into the toilet bowl and a control device which actuates the toilet flushing device to supply a predetermined amount of flush water into the toilet bowl before actuating the lock device so that the closing tool is locked in the closing state when the private parts cleaning device is actuated and an amount of cleaning water ejected from the cleaning nozzle equals or exceeds the set amount.

In this case, the toilet flushing device is actuated and the set amount of flush water is supplied into the toilet bowl before the lock device is actuated and the closing tool is locked in the closing state. Consequently, the private parts cleaning water having the higher impurity degree in the toilet bowl can completely be discharged into the waste collection tub, whereupon the impurity degree of the private parts cleaning water flowing into the drainage channel can reliably be reduced.

The discharge part may be connected to the drain outlet in the second invention and the apparatus may further comprise a connecting device including a closing tool which opens and closes the discharge part and a lock device which locks the closing tool in a closing state in which the discharge part is closed, the drainage channel being formed by branching the discharge part at an upstream side with respect to the closing tool, and a control device which actuates the lock device so that the closing tool is locked in the closing state, while the cleaning nozzle is being cleaned by the nozzle cleaning mechanism.

In this case, the closing tool is locked in the closing state while the cleaning nozzle is being cleaned by the nozzle cleaning mechanism. Consequently, since the nozzle cleaning water having a lower impurity degree is caused to flow into the drainage channel, an amount of water discharged into the waste collection tub can be reduced.

The toilet apparatus may further comprise a second control device which prevents actuation of the toilet flushing device supplying flush water into the toilet bowl, while the private parts cleaning device is being actuated. In this case, a control manner of the control device can be simplified.

Furthermore, the private parts cleaning water flowing into the toilet bowl by the actuation of the private parts cleaning device may wash away waste adherent to the inner surface of the toilet bowl. In this case, the toilet flushing device need not be actuated to flush the toilet bowl. Consequently, since water can be prevented from being used uneconomically, an amount of water discharged into the waste collection tub can be reduced.

The discharge part may be connected to the drain outlet in the third invention and the apparatus may further comprise a connecting device including a closing tool which opens and closes the discharge part and a lock device which locks the closing tool in a closing state in which the discharge part is closed, the drainage channel being formed by branching the discharge part at an upstream side with respect to the closing tool, and a control device which actuates the lock device during execution of the cleaning flushing so that the closing tool is locked in the closing state.

In this case, since the closing tool is locked in the closing state during execution of the cleaning flushing, the cleaning water is supplied into the toilet bowl and flows through the drain outlet of the toilet bowl has a lower impurity degree and accordingly flows into the drainage channel. Accordingly, an amount of water to be discharged into the waste collection tub can be reduced. Furthermore, the cleaning water containing a cleaning detergent used in the cleaning flushing can also be prevented from being discharged into the waste collection tub.

The toilet flushing device may include a storage tank communicating with a downstream side with respect to the drainage channel and a water supply device supplying flush water stored in the storage tank into the toilet bowl. In this case, the flush water with a lower impurity degree flows into the drainage channel and is stored in the storage tank. The stored flush water is supplied into the toilet bowl by the water supply device, with the result that the toilet flushing can be executed. Consequently, the toilet apparatus can execute toilet flushing by the reuse of the flush water.

The waste collection tub may accommodate a bacterial bed which ferments and decompose the waste or the like. In this case, the waste or the like discharged into the waste collection tub can be fermented and decomposed in the bacterial bed. Furthermore, since an amount of water discharged into the waste collection tub is small, the bacterial bed can be prevented from being excessively watered, and accordingly, the waste or the like can be fermented and decomposed well.

Embodiments 1 and 2 embodying the toilet apparatus according to the first invention, the second invention and the third invention will now be described with reference to the drawings.

<Embodiment 1>

A toilet apparatus of embodiment 1 includes a toilet body 10, a discharge part 20, a drainage channel 30, a toilet flushing device 40, a private parts cleaning device 50, a detecting device 60, a control device 70 and a connecting device 80.

The toilet body 10 is provided with a toilet bowl 11 having a drain outlet 11A in a lower part thereof. The toilet bowl 11 has a rim water passage 12 formed along an upper inner periphery of the toilet bowl 11 so that flush water discharged from a rim discharge conduit 13 flows along the upper inner periphery of the toilet bowl 11. Since flush water flowing through the rim water passage 12 steadily flows downward along an inner surface of the toilet bowl 11, an entire inner surface of the toilet bowl can be flushed by flush water.

The connecting device 80 is connected to the drain outlet 11A of the toilet bowl 11. The connecting device 80 forms the discharge part 20 communicating the drain outlet 11A to a waste collection tub 90 which will be described later. The connecting device 80 has a generally conical inlet 81 having an upper end opening connected to an outer peripheral surface of the drain outlet 11A and an open lower end continuous from the upper end opening.

The connecting device 80 has a cylindrical intermediate pipe 82 located lower than the lower end opening of the inlet 81. The intermediate pipe 82 has an inclined surface 82A further having an upper end inclined obliquely upward from an inner peripheral surface toward an outer peripheral surface. An upper end opening edge 82B of the intermediate pipe 82 is located above and outside a lower end opening edge 81A of the inlet 81. A gap X is defined between the upper inclined surface 82A of the intermediate pipe 82 and an outer peripheral surface of the lower end of the inlet 81 so that flush water passes through the gap X.

The connecting device 80 has a connecting portion 83 connecting between an upper outer surface of the inlet 81 and the outer surface of the intermediate pipe 82. The connecting portion 83 has a cylindrical outer surface. The drainage channel 30 is formed by outwardly extending a part of the outer surface of the connecting portion 83. The drainage channel 30 is branched off from the discharge part 20 at an upstream side of a closing tool 85 which will be described later via the gap X and an inner space of the connecting portion 83.

The connecting device 80 has an outlet 84 which is connected to the outer surface of the intermediate pipe 82 and has an open lower end. The outlet 84 is formed into a generally cylindrical shape and has a diameter that is gradually reduced downward. The outlet 84 has a lower end opening connected to a through hole 92 formed through a floor surface F on which the toilet body 10 is installed. The through hole 92 communicates with the waste collection tub 90 provided below the floor surface F. The waste collection tub 90 is provided below the toilet body 10. The waste collection tub 90 accommodates a bacterial bed 91 fermenting and decomposing waste therein. The bacterial bed 91 is formed by cultivating aerobic microbe in a breeding ground of wood chips, sawdust, or the like.

The closing tool 85 has a receiving member 86 and a supporting member 87. The outlet 84 has a rotating shaft 87A on an upper inner surface thereof. The supporting member 87 is rotatably supported on the rotating shaft 87A. The receiving member 86 is formed into the shape of a saucer and has a disc-shaped central portion and an edge which is continuous to an outer peripheral edge of the central portion and is inclined obliquely upwardly outward. The supporting member 87 has one end located at the receiving member 86 side and the other end which is located at the side opposite the receiving member 86. A weighting member 88 made of iron is connected to the other end of the supporting member 87 with the rotating shaft 87A being located between the supporting member 87 and the weighting member 88. The weight of the weighting member 88 is set so that the receiving member 86 side is lowered when load to be applied to the receiving member 86 equals or exceeds a predetermined value.

Accordingly, the receiving member 86 is moved upward about the rotating shaft 87A in a normal state (in the state where the toilet body 10 is not used, such as a stand-by state). As a result, the receiving member 86 abuts against the lower opening edge 82C of the intermediate pipe 82, thereby closing the discharge part 20. On the other hand, when waste, flush water or the like, the weight of which equal or exceeds the predetermined value, is placed on the upper surface of the receiving member 86, the receiving member 86 is lowered about the rotating shaft 87A, thereby opening the discharge part 20. The upper surface of the receiving member 86 is inclined nearly to a vertical state when the receiving member 86 is lowered. Accordingly, the waste, flush water or the like placed on the upper surface of the receiving member 86 falls to be discharged into the waste collection tub 90. When the waste, flush water or the like has fallen from the upper surface of the receiving member 86, the weighting member 88 moves the receiving member 86 upward about the rotating shaft 87A, whereupon the receiving member 86 automatically returns to the closing state in which the receiving member 86 abuts against the lower opening edge 82C of the intermediate pipe 82 thereby to close the discharge part 20.

An electromagnet 89 is mounted on the outer surface of the outlet 84 opposite to the inner surface against which the weighting member 88 abuts while the receiving member 86 is in abutment against the lower opening edge 82C of the intermediate pipe 82, thereby closing the discharge part 20. When energized, the electromagnet 89 attracts the weighting member 88 by the magnetic force thereof, whereupon the receiving member 86 can be locked in the closing state in which the receiving member 86 abuts against the lower opening edge 82C of the intermediate pipe 82, thereby closing the discharge part 20. More specifically, the electromagnet 89 serves as a lock device which locks the closing tool 85 in the closing state in which the discharge part is closed. The switching between energization and deenergization of the electromagnet 89 is controlled by a control device 70 which will be described later.

The toilet flushing device 40 includes a storage tank 41 communicating with the downstream side of the drainage channel 30, and a water supply device 42 which supplies flush water stored in the storage tank 41 to the toilet bowl 11. A mesh filter member 43 is incorporated in the storage tank 41. The drainage channel 30 drawn into the storage tank 41 has a discharge outlet located above the filter member 43. Accordingly, flush water flowing down the drainage channel 30 to be discharged from the discharge outlet is stored in the storage tank 41 while solids with certain sizes contained in the flush water is removed by the filter member 43. The storage tank 41 is provided with chlorine agent supply cylinder 44 for sterilization by chlorine. The storage tank 41 further has a ball tap 45 communicating with the water supply path 1 connected to a water pipe S, whereby tap water can be supplied via the water supply path 1 into the storage tank 41 when the water level in the storage tank 41 drops.

The water supply device 42 has a water supply conduit 46 provided with a water supply port in a lower interior of the storage tank 41 and a pump P provided in the middle of the water supply conduit 46. The water supply conduit 46 has a downstream end connected to an upstream end of the rim discharge conduit 13. The pump P is actuated so that flush water in the storage tank 41 is supplied via the water supply conduit 46 and the rim discharge pipe 13 into the toilet bowl 11. The actuation of the pump P is controlled by the control device 70 as will be described later.

The private parts cleaning device 50 includes a cleaning nozzle 51, a cylinder member 52 for accommodating the cleaning nozzle 51 and a warm water tank 53 communicating with an upstream side of the cleaning nozzle 51. The cleaning nozzle 51 is reciprocally moved by an electromagnet motor (not shown) between an accommodation position where the cleaning nozzle 51 is accommodated in the cylinder member 52 and a forward position where the cleaning nozzle 51 protrudes forward from a front end of the cylinder member 52. The cleaning nozzle 51 ejects private parts cleaning water from a cleaning hole provided in a distal end thereof when located at the forward position. The warm water tank 53 communicates with the water supply path 1 provided with an on-off valve V and stores cleaning water flowing through the water supply path 1, at a set temperature. A temperature of cleaning water in the warm water tank 53, the drive of the electromagnetic motor and on-off operation of the on-off valve V are controlled by the control device 70 which will be described later.

The private parts cleaning device 50 has a nozzle cleaning mechanism which cleans the cleaning nozzle 51. The nozzle cleaning mechanism has a branch passage which is branched off via a switching valve from a communicating path communicating between the warm water tank 53 and the cleaning nozzle 51. The nozzle cleaning mechanism ejects cleaning water from a discharge port of a downstream end of the branch passage toward a distal end of the cleaning nozzle 51 retreated to the accommodation position, thereby cleaning the distal end of the cleaning nozzle 51. The switching of the switching valve is controlled by the control device 70 which will be described later.

The private parts cleaning device 50 is housed in a toilet seat box 2 mounted to the upper rear of the toilet body 10 and assembled to the toilet body 10. The toilet seat box 2 has on a front end thereof a support shaft which supports the toilet cover 3 and the toilet seat 4 so that the toilet cover 3 and the toilet seat 4 are rotatable. Each of the toilet cover 3 and the toilet seat 4 is rotated between a rising state and a laid state by an electromagnet motor (not shown). The drive of the electromagnet motor is controlled by the control device 70 which will be described later.

A seat occupant detecting device is incorporated in the toilet seat 4. The seat occupant detecting device comprises a capacitance type sensor and can detect a user seated on the toilet seat 4. The seat occupant detecting device generates and delivers a signal indicative of presence or absence of the user seated on the toilet seat 4 to the control device which will be described later.

A detecting device 60 is mounted on a front end of the upper surface of the toilet seat box 2. The detecting device 60 comprises an infrared sensor and can detect a user in a set area in front of the toilet body 10. The detecting device 60 generates and delivers a signal indicative of presence or absence of the user to the control device which will be described later.

The control device 70 is housed in the toilet seat box 2. The control device 70 has a receiving section 70A receiving an operation signal transmitted from a remote controller 71. The remote controller 71 is mounted on a wall surface W of a toilet room in which the toilet body 10 is installed. The remote controller 71 has various operation buttons including a toilet flush button 72, a private parts cleaning button 73, a stop button 74, a nozzle cleaning button 75 and a cleaning button 76. The remote controller 71 has a transmission section 71A which transmits to the receiving section 70A an operation signal according to operation of each operation button. The remote controller 71 has a lid member 71B opening and closing a part of the front. Operation buttons each having a lower use frequency, such as the nozzle cleaning button 75 and the cleaning button 76, are provided on an operation surface exposed when the lid member 71B is opened.

Figure 8:
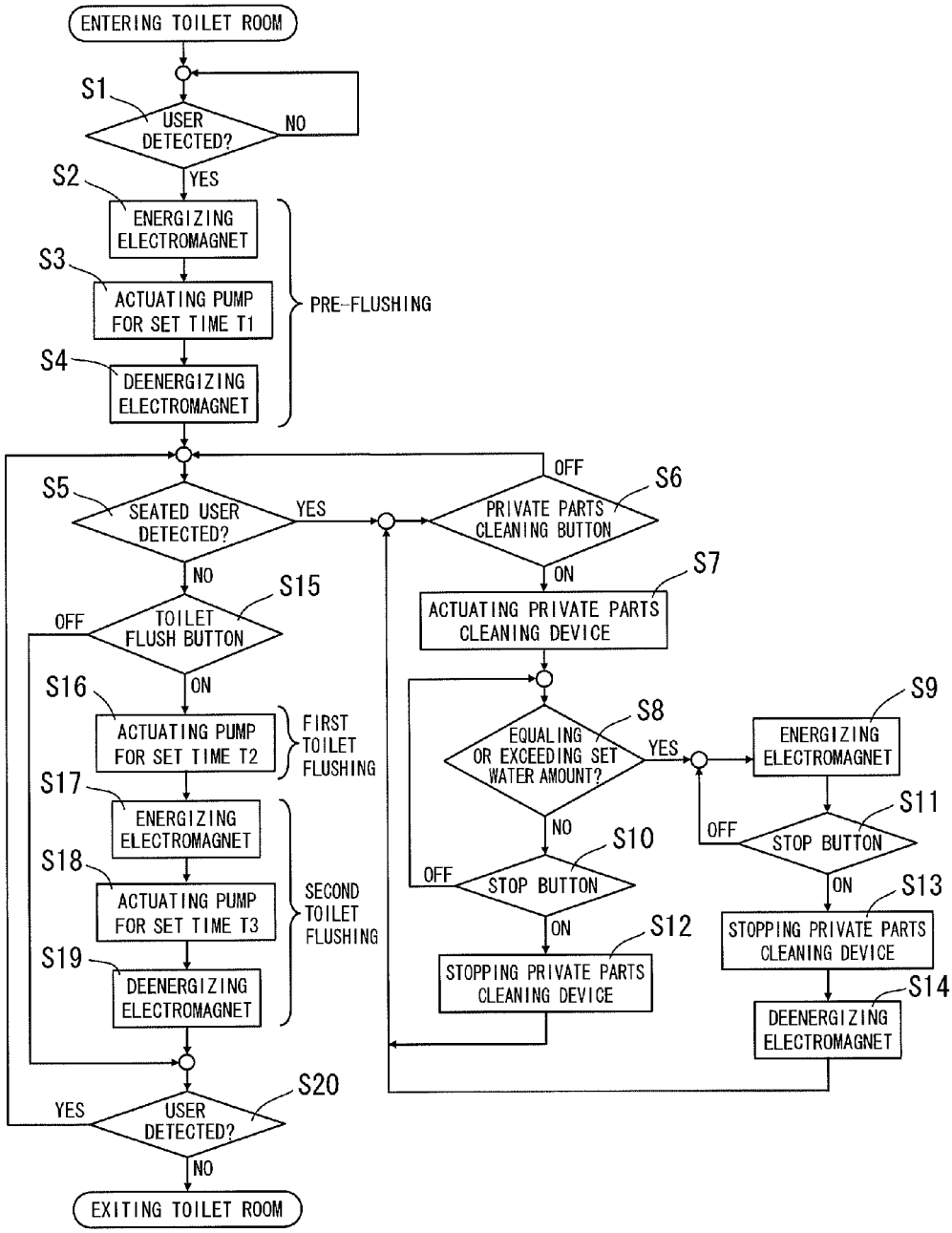
FIG. 8 is a flowchart showing operations of pre-flushing, waste discharge, private parts cleaning and toilet flushing executed by the toilet apparatus according to embodiment 1.

Operations of "pre-flushing," "waste discharge," "private parts cleaning" and "toilet flushing" of the toilet apparatus configured as described above will now be described with reference to FIG. 8.

[Pre-Flushing]

The detecting device 60 generates and delivers a detection signal to the control device 70 when detecting a user entering the toilet room and being within the predetermined area in front of the toilet body 10 (step S1). The control device 70 then drives the electromagnetic motor to rotate the toilet cover 3 to the rising state and causes the pre-flushing to be executed in the following manner.

In the pre-flushing, the electromagnet 89 is firstly energized so that the lock device is actuated to lock the closing tool 85 in the closing state in which the discharge part 20 is closed (step S2). Subsequently, the pump P of the toilet flushing device 40 is actuated for a set time T1 (0.3 sec., for example; and step S3). Furthermore, the electromagnet 89 is deenergized after the actuation of the pump P has been stopped, whereby the closing tool 85 is unlocked (step S4).

Flush water in the storage tank 41 is supplied through the water supply conduit 46 and the rim discharge conduit 13 into the rim water passage 12 of the toilet bowl 11 by the execution of the pre-flushing. Since the flush water flowing through the rim water passage 12 gradually flows downward along the inner surface of the toilet bowl 11, the whole inner surface of the toilet bowl 11 can be wetted by the flush water. As a result, waste or the like can be rendered more difficult to adhere to the inner surface of the toilet bowl 11.

Thus, the purpose of the pre-flushing is to reduce the possibility of waste or the like adhering to the inner surface of the toilet bowl 11 and the upper surface of the closing tool 85. Accordingly, an amount of flush water supplied to the toilet bowl 11 by the execution of the pre-flushing is smaller than an amount of flush water to be supplied into the toilet bowl 11 in the actual toilet flushing which will be described later. Furthermore, the flush water supplied to the toilet bowl 11 and flowing into the drain outlet 11A of the toilet bowl 11 by the execution of the pre-flushing has a lower impurity degree.

The weighting member 88 is attracted by the magnetic force of the electromagnet 89 during actuation of the pump P of the toilet flushing device 40, whereupon the closing tool 85 is in abutment with the lower opening edge 82C of the intermediate pipe 82 thereby to close the discharge part 20. The closing tool 85 is locked in the closing state. Accordingly, flush water supplied into the toilet bowl 11 by execution of the pre-flushing overflows the upper end opening edge 82B of the intermediate pipe 82 into the connecting portion 83 thereby to flow into the drainage channel 30 without being discharged into the waste collection tub 90. Consequently, the toilet apparatus can reduce an amount of water discharged into the waste collection tub 90. This can prevent the bacterial bed 91 from being excessively watered, with the result that the waste or the like can be fermented and decomposed well.

Furthermore, lower impurity flush water flowing into the drainage channel 30 can be stored in the storage tank 41. The flush water stored in the storage tank 41 is sterilized by the use of chlorine and supplied to the toilet bowl 11 by the water supply device 42 thereby to be used for toilet flushing. Consequently, the toilet apparatus can recirculate and reuse the flush water supplied into the toilet bowl 11 by the execution of pre-flushing.

[Waste Discharge]

When detecting the user having been seated on the toilet seat 4 after end of the pre-flushing, the occupant detecting device transmits a detection signal to the control device 70 (step S5). The closing tool 85 is unlocked after end of the pre-flushing. Accordingly, when waste, flush water or the like with an amount equaling or exceeding the set amount is placed on the upper surface of the closing tool 85, the closing tool 85 is lowered about the pivot shaft 86A thereby to open the discharge part 20.

Figure 4:
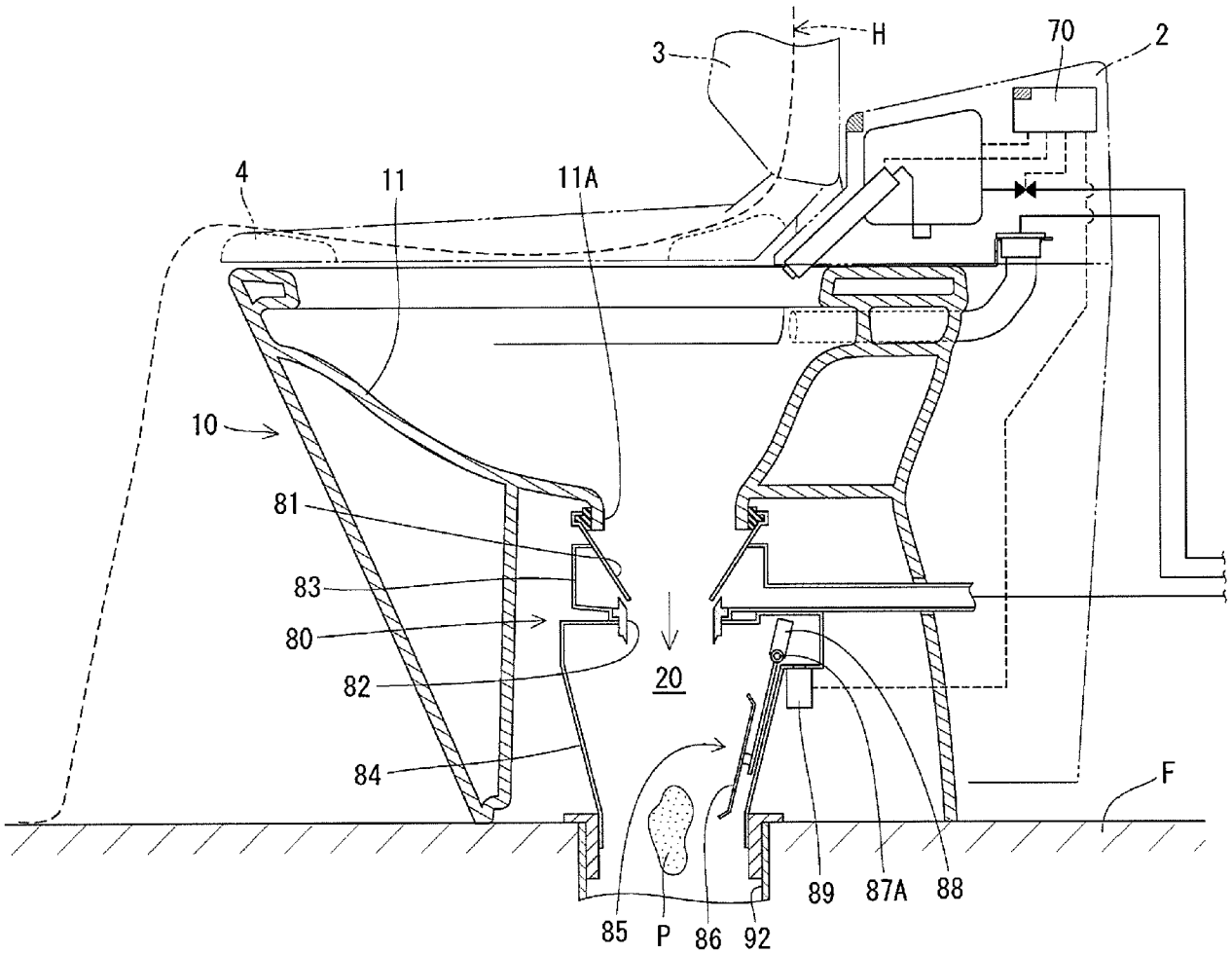
FIG. 4 is a schematic view of the toilet apparatus according to embodiments 1 and 2, showing a waste discharge state.

Accordingly, as shown in FIG. 4, when the user H excretes waste P, which equals or exceeds the set amount and is placed on the upper surface of the closing tool 85, the closing tool 85 is lowered about the pivot shaft 86A thereby to open the discharge part 20. Since the upper surface of the closing tool 85 is inclined nearly to a vertical state when the closing tool 85 is lowered about the pivot shaft 86A, the waste P or the like placed on the upper surface of the closing tool 85 falls downward to be discharged into the waste collection tub 90. When the waste P or the like has fallen from the upper surface of the closing tool 85, the weighting member 88 moves the closing tool 85 upward about the pivot shaft 86A, so that the closing tool 85 abuts against the lower opening edge 82C of the intermediate pipe 82 thereby to close the discharge part 20. The closing tool 85 thus automatically returns to the original state. The closing tool 85 thus repeats the opening and closing of the discharge part 20 depending upon excretion of waste P by the user. The waste or the like discharged into the waste collection tub 90 is fermented and decomposed by the bacterial bed 91.

[Private Parts Cleaning]

When the user presses a private parts cleaning button 73 of the remote controller 71, the transmission section 71A transmits a private parts cleaning signal to the receiving section 70A of the control device 70 (step S6). When the receiving section 70A receives the private parts cleaning signal, the control device 70 drives the electromagnet motor to move the cleaning nozzle 51 to the forward position and opens the on-off valve V and actuates the private parts cleaning device 50 (step S7).

Subsequently, when an amount of water equals or exceeds a set amount (step S8), the control device 70 energizes the electromagnet 89 to actuate the lock device and locks the closing tool 85 in the closing state in which the discharge part 20 is closed (step S9).

In this case, an amount of water ejected from the cleaning nozzle 51 is converted to an ejection time according to a flow rate of private parts cleaning water ejected from the cleaning nozzle 51, and the control device 70 controls an opening time of the on-off valve V. More specifically, the control device 70 energizes the electromagnet 89 upon lapse of a set time after the on-off valve V has been opened.

Figure 5:
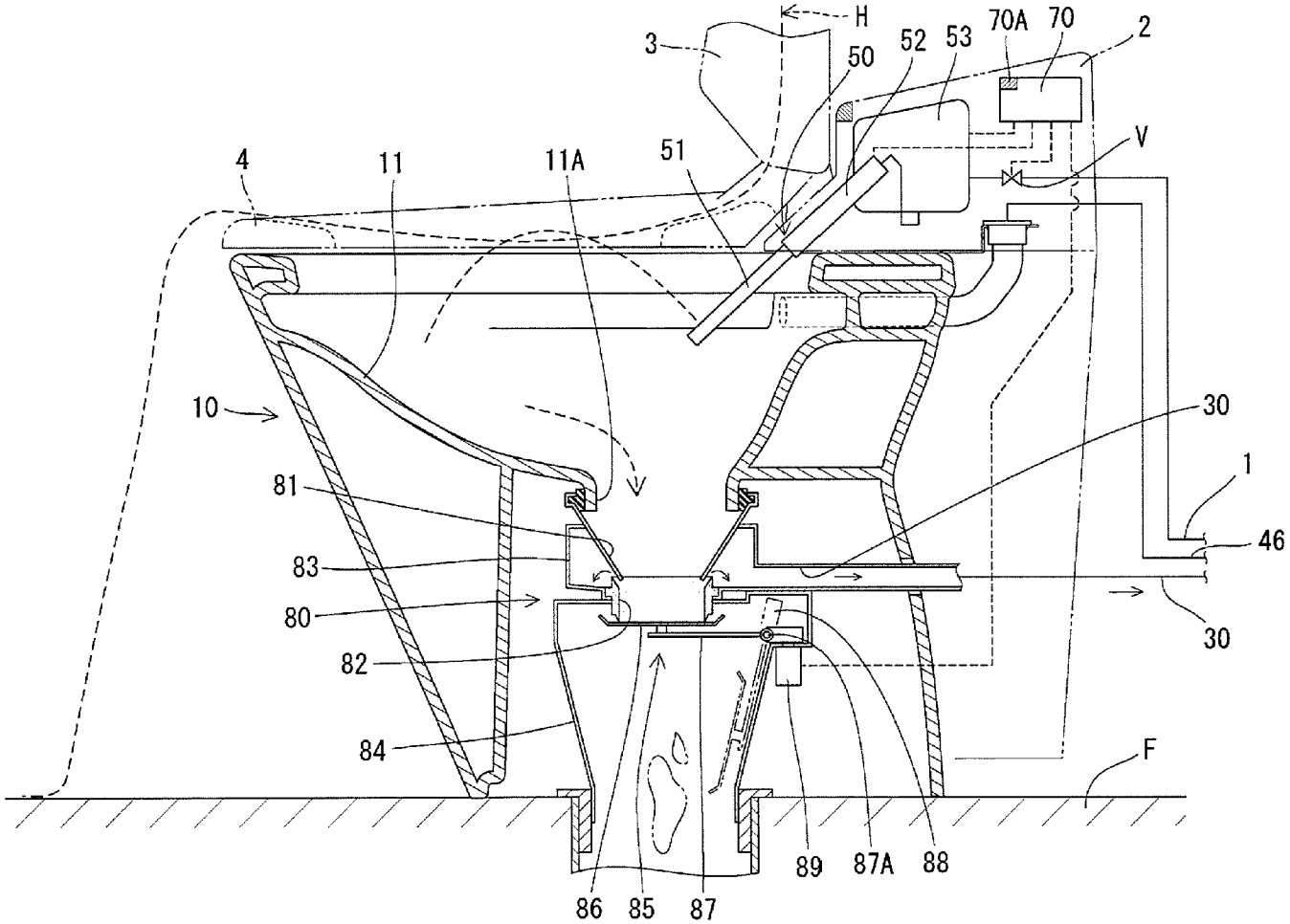
FIG. 5 is a schematic view of the toilet apparatus according to embodiments 1 and 2, showing execution of private parts cleaning.
Figure 6:
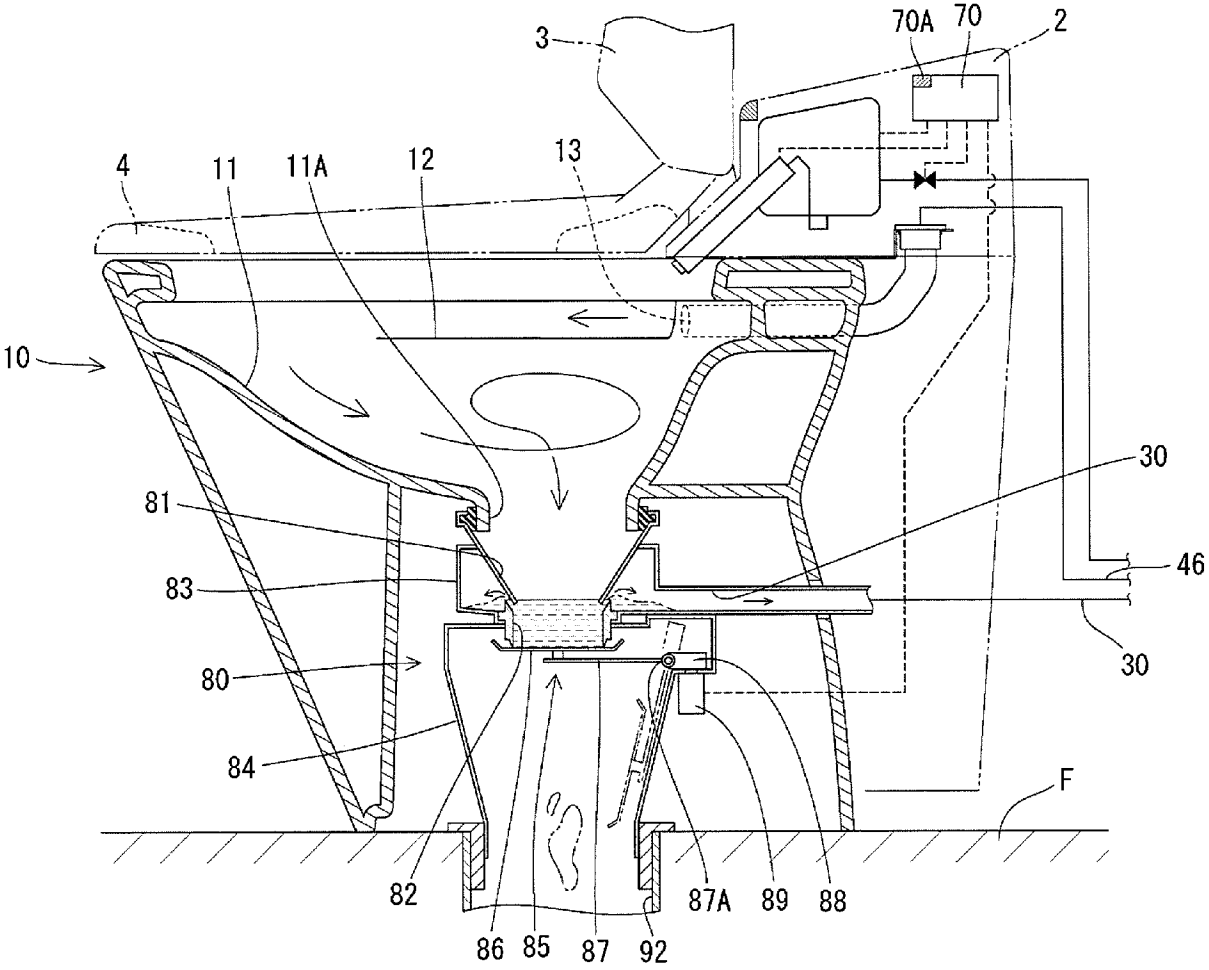
FIG. 6 is a schematic view of the toilet apparatus according to embodiments 1 and 2, showing execution of toilet flushing.

When the on-off valve V is opened, as shown in FIG. 5, cleaning water supplied via the warm water tank 53 from the water supply path 1 is ejected from the cleaning hole provided in the distal end of the cleaning nozzle 51 which has been moved to the forward position, so that the private parts cleaning is executed. When the set time elapses after the opening of the on-off valve V (the private parts cleaning is executed and an amount of private parts cleaning water ejected from the cleaning nozzle 51 equals or exceeds the set amount), the electromagnet 89 is energized, whereby the weighting member 88 is attracted by the magnetic force of the electromagnet 89, with the result that the closing tool 85 abuts against the lower opening edge 82C of the intermediate pipe 82 and is locked in the closing state in which the discharge part 20 is closed.

Since waste adhered to buttocks of the user is washed away in an initial stage in execution of the private parts cleaning, the private parts cleaning water flowing into the toilet bowl 11 has a higher impurity degree. The private parts cleaning water whose amount allows the closing tool 85 to open the discharge part 20 is ejected from the cleaning nozzle 51 before the closing tool 85 is locked in the closing state in which the discharge part 20 is closed (before the set time elapses from the opening of the on-off valve V). As a result, the private parts cleaning water with the higher impurity degree is discharged to the waste collection tub 90.

The private parts cleaning water falling into the toilet bowl 11 to flow into the drain outlet 11A of the toilet bowl 11 has a lower impurity degree when the private parts cleaning device 50 is continuously actuated and the set time elapses from the opening of the on-off valve V. In this case, since the electromagnet 89 is energized, the closing tool 85 is locked in the closing state in which the discharge part 20 is closed. Accordingly, the private parts cleaning water with the lower impurity degree overflows the upper end opening edge 82B of the intermediate pipe 82 into the connecting portion 83 thereby to flow into the drainage channel 30 without being discharged into the waste collection tub 90. Consequently, the toilet apparatus can reduce an amount of water discharged into the waste collection tub 90. This can prevent the bacterial bed 91 from being excessively watered, with the result that the waste or the like can be fermented and decomposed well.

Furthermore, private parts cleaning water flowing into the drainage channel 30 and having the lower impurity degree is stored in the storage tank 41. The private parts cleaning water stored in the storage tank 41 is sterilized by the use of chlorine and supplied by the water supply device 42 into the toilet bowl 11 thereby to be used for toilet flushing. Thus, the toilet apparatus can recirculate and reuse part of the private parts cleaning water ejected from the cleaning nozzle 51 by the execution of the private parts cleaning.

When the user presses a stop button 74 of the remote controller 71 during actuation of the private parts cleaning device 50, a stop signal is transmitted from the transmission section 71A to the receiving section 70A (steps S10 and S11). When the receiving section 70A receives the stop signal, the control device 70 drives the electromagnet motor to move the cleaning nozzle 51 to the accommodation position and closes the on-off valve V to stop actuation of the private parts cleaning device 50 (steps S12 and S13). As a result, the private parts cleaning is completed. Furthermore, when the electromagnet 89 is being energized, the control device 70 ends the energization of the electromagnet 89 (step S14).

When the user presses the private parts cleaning button after having pressed the stop button 74 of the remote controller so that the private parts cleaning device 50 is repeatedly actuated, the control device 70 resets the opening time of the on-off valve V every time the stop button 74 is pressed, measuring the opening time of the on-off valve V from the most recent opening of the on-off valve V. The control device 70 energizes the electromagnet 89 upon lapse of the set time. The reason for this is that there is a possibility that the user may excrete waste after stop button 74 of the remote controller 71 has been pressed and before the private parts cleaning button 73 is pressed.

[Toilet Flushing]

When the user presses a toilet flush button 72 of the remote controller 71, a toilet flush signal is transmitted from the transmission section 71A to the receiving section 70A of the controller 70 (step S15). When the receiving section 70A receives the toilet flush signal, the control device 70 controls the toilet apparatus so that the following toilet flushing is executed.

In the toilet flushing, the pump P of the toilet flushing device 40 is firstly actuated for a set time (0.5 sec., for example) so that a first toilet flushing is executed (step S16). Next, the control device 70 energizes the electromagnet 89 and actuates the lock device to lock the closing tool 85 in the closing state in which the discharge part 20 is closed (step S17), then starting a second toilet flushing. The control device 70 then actuates the pump P of the toilet flushing device 40 for a set time T3 (3.5 sec, for example; and step S18). Furthermore, the control device 70 deenergizes the electromagnet 89 to unlock the closing tool 85 (step S19), thereby ending the second toilet flushing.

Thus, flush water stored in the storage tank 41 is supplied through the water supply conduit 46 and the rim discharge conduit 13 to the rim water passage 12 of the toilet bowl 11, whereby the toilet flushing is executed. Since the electromagnet 89 is not energized in the first toilet flushing, the closing tool 85 is lowered about the pivot shaft 86A thereby to open the discharge part 20 when waste P, flush water or the like with the weight equaling or exceeding the set weight is placed on the upper surface of the closing tool 85. Accordingly, waste or toilet paper adherent to the inner surface of the toilet bowl 11 and waste or toilet paper adherent to the upper surface of the closing tool 85 can be discharged into the waste collection tub 90 by flush water supplied in the first toilet flushing.

Flush water supplied to the toilet bowl 11 in the subsequent second toilet flushing and flowing into the drain outlet 11A has a lower impurity degree. Furthermore, since the electromagnet 89 is energized, the weighting member 88 is attracted by the magnetic force of the electromagnet 89, whereby the closing tool 85 is in abutment with the lower opening edge 82C of the intermediate pipe 82 thereby to close the discharge part 20. The closing tool 85 is locked in the closing state. Accordingly, flush water supplied into the toilet bowl 11 overflows the upper end opening edge 82B of the intermediate pipe 82 into the connecting portion 83 thereby to flow into the drainage channel 30 without being discharged into the waste collection tub 90. Consequently, the toilet apparatus can reduce an amount of water discharged into the waste collection tub 90. This can prevent the bacterial bed 91 from being excessively watered, with the result that the waste or the like can be fermented and decomposed well.

Furthermore, the flush water having the lower impurity degree and flowing into the drainage channel 30 is stored in the storage tank 41. The flush water stored in the storage tank 41 is sterilized by the use of chlorine and supplied to the toilet bowl 11 by the water supply device 42 thereby to be used for toilet flushing. Consequently, the toilet apparatus can recirculate and reuse part of the flush water supplied into the toilet bowl 11 by the execution of toilet flushing.

After end of the toilet flushing, the detecting device 60 generates and delivers a detection signal to the control device 70 when detecting absence of the user within the predetermined area in front of the toilet body 10 (step S20). The toilet apparatus then returns to the standing state.

When the user presses the toilet flushing button 72 of the remote controller 71 during actuation of the private parts cleaning device 50, a toilet flush signal is transmitted from the transmission section 71A to the receiving section 70A of the control device 70. In this case, while the private parts cleaning device 50 is being actuated, the control device 70 does not actuate the pump P of the toilet flushing device 40 even when the receiving section 70A receives the toilet flush signal. Accordingly, the toilet apparatus does not execute toilet flushing during the private parts cleaning.

Thus, the control of the control device 70 can be simplified. Furthermore, waste or the like adherent to the inner surface of the toilet bowl 11 can be washed away by the private parts cleaning water flowing into the toilet bowl 11 by the actuation of the private parts cleaning device 50. In this case, since flushing the toilet bowl 11 by the actuation of the toilet flushing device 40 is not required, water can be prevented from being used in vain and an amount of water discharged to the waste collection tub 90 can be reduced.

Figure 9:
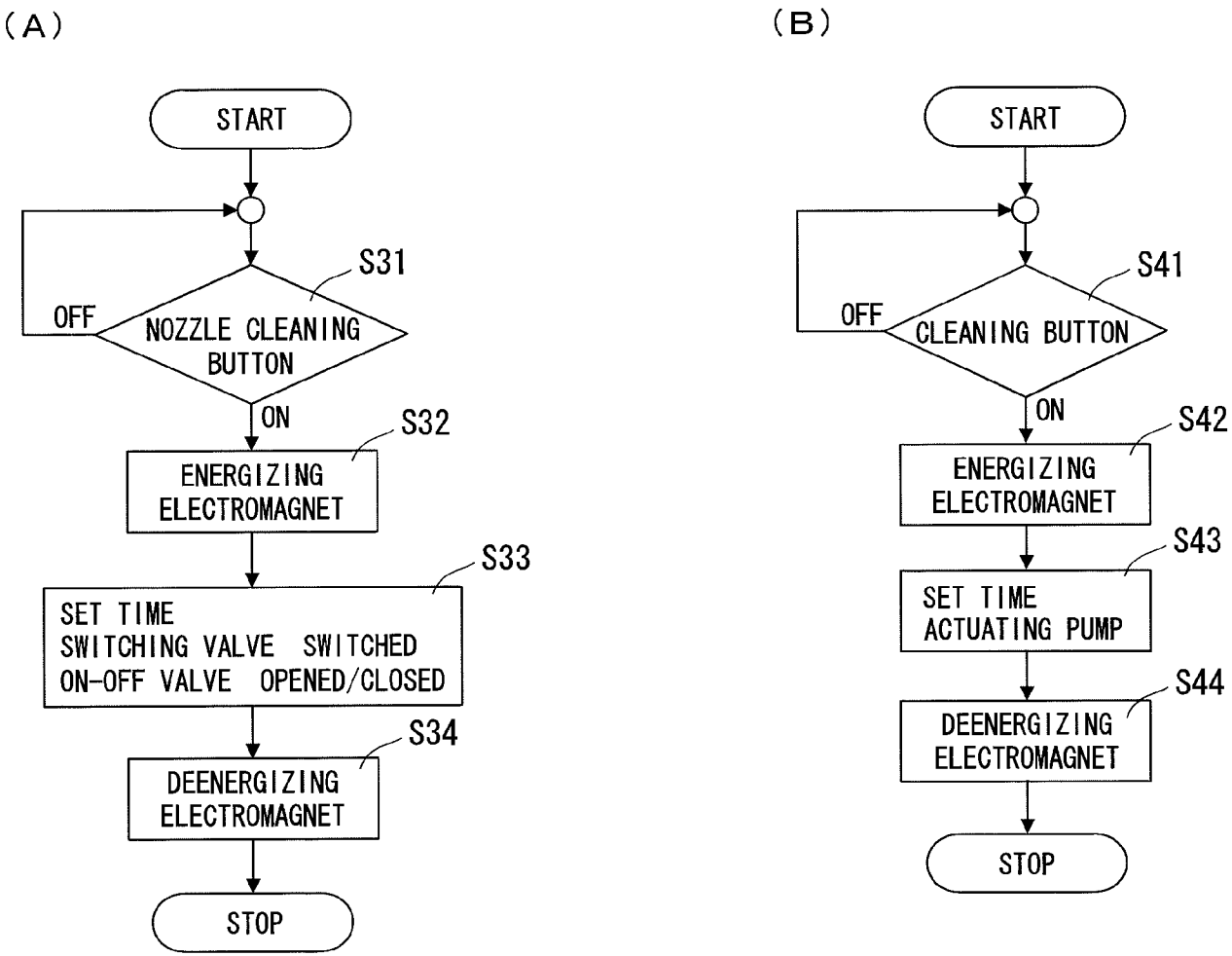
FIGS. 9A and 9B are a flowchart showing the nozzle cleaning operation of the toilet apparatus according to embodiment 1 and a flowchart showing the cleaning flushing of the toilet apparatus according to embodiment 1 respectively.

A "nozzle cleaning" operation of the toilet apparatus will be described with reference to FIG. 9A.

[Nozzle Cleaning]

Figure 7:
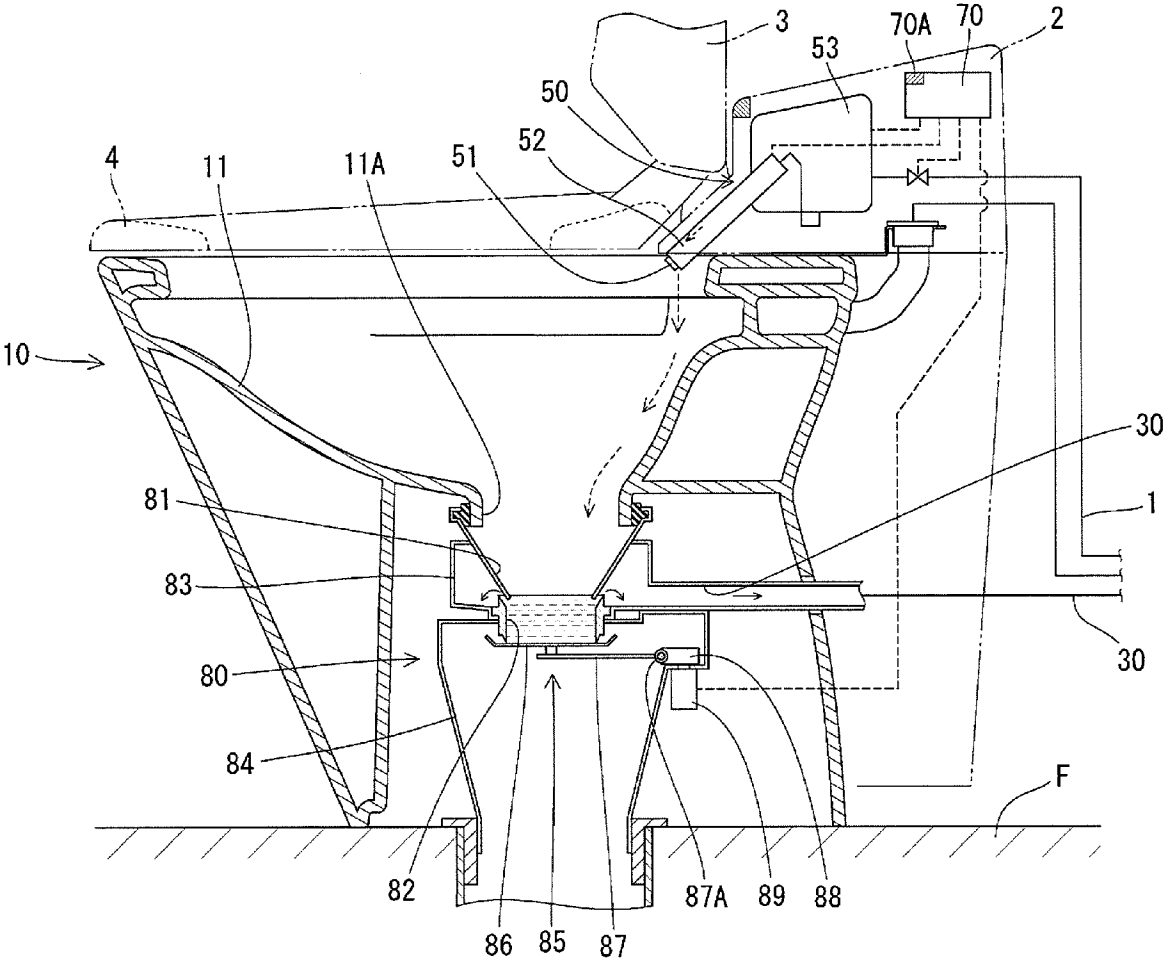
FIG. 7 is a schematic view of the toilet apparatus according to embodiments 1 and 2, showing execution of nozzle cleaning.

When the user presses a nozzle cleaning button 75 of the remote controller 71, a nozzle cleaning signal is transmitted from the transmission section 71A to the receiving section 70A of the control device 70 (step S31). When the receiving section 70A receives the nozzle cleaning signal, the control device 70 energizes the electromagnet 89 to actuate the lock device and locks the closing tool 85 in the closing state in which the discharge part 20 is closed (step S32). The control device 70 then switches the switching valve for a set time so that cleaning water flows into the branched water passage and opens the on-off valve V (step S33). As a result, as shown in FIG. 7, cleaning water is supplied from the water supply path 1 through the warm water tank 53, the switching valve and the branched passage. The cleaning water is ejected toward the distal end of the cleaning nozzle 51 retracted to the accommodation position, whereby the nozzle cleaning is executed. After ending the nozzle cleaning upon lapse of the set time, the control device 70 finishes energization of the electromagnet 89 and unlocks the closing tool 85 (step S34).

Nozzle cleaning water that has been used to clean the cleaning nozzle 51 and flowed into the drain outlet 11A has a lower impurity degree. Furthermore, the weighting member 88 is attracted by the magnetic force of the electromagnet 89 during the nozzle cleaning, and the closing tool 85 is in abutment with the lower opening edge 82C of the intermediate pipe 82 thereby to be locked in the closing state in which the discharge part 20 is closed.

Accordingly, the nozzle cleaning water with the lower impurity degree overflows the upper end opening edge 82B of the intermediate pipe 82 into the connecting portion 83 thereby to flow into the drainage channel 30 without being discharged into the waste collection tub 90. Consequently, the toilet apparatus can reduce an amount of water discharged into the waste collection tub 90. This can prevent the bacterial bed 91 from being excessively watered, with the result that the waste or the like can be fermented and decomposed well.

Furthermore, nozzle cleaning water flowing into the drainage channel 30 and having the lower impurity degree is stored in the storage tank 41. The nozzle cleaning water stored in the storage tank 41 is sterilized by the use of chlorine and supplied by the water supply device 42 into the toilet bowl 11 thereby to be used for toilet flushing. Thus, the toilet apparatus can recirculate and reuse part of the nozzle cleaning water.

A "cleaning flushing" operation of the toilet apparatus will be described with reference to FIG. 9B.

[Cleaning Flushing]

When the user presses a cleaning button 76 of the remote controller 71, a cleaning flushing signal is transmitted from the transmission section 71A to the receiving section 70A of the control device 70 (step S41). When the receiving section 70A receives the cleaning flushing signal, the control device 70 energizes the electromagnet 89 to actuate the lock device, so that the closing tool 85 is locked in the closing state in which the discharge part 20 is closed (step S42). The control device 70 then actuates the pump P of the toilet flushing device 40 for a predetermined time (step S43). As a result, flush water in the storage tank 41 is supplied through the water supply conduit 46 and the rim discharge conduit 13 to the rim water passage 12 of the toilet bowl 11, whereby the cleaning flushing is executed. After having ended the cleaning flushing upon lapse of the set time, the control device 70 finishes energization of the electromagnet 89 and unlocks the closing tool 85 (step S44).

Flush water that has been supplied to the toilet bowl 11 by the execution of the cleaning flushing and flowed into the drain outlet 11A has a lower impurity degree. Furthermore, the weighting member 88 is attracted by the magnetic force of the electromagnet 89 during the cleaning flushing, and the closing tool 85 is in abutment with the lower opening edge 82C of the intermediate pipe 82 thereby to be locked in the closing state in which the discharge part 20 is closed.

Accordingly, the flush water with the lower impurity degree overflows the upper end opening edge 82B of the intermediate pipe 82 into the connecting portion 83 thereby to flow into the drainage channel 30 without being discharged into the waste collection tub 90. Consequently, the toilet apparatus can reduce an amount of water discharged into the waste collection tub 90. Furthermore, the toilet apparatus can prevent flush water containing the detergent used in the cleaning flushing from being discharged into the waste collection tub 90. This can prevent the bacterial bed 91 from being excessively watered and can further prevent aerobic microbe from being destroyed by the detergent, with the result that the waste or the like can be fermented and decomposed well.

Furthermore, flush water flowing into the drainage channel 30 and having the lower impurity degree is stored in the storage tank 41. The flush water stored in the storage tank 41 is sterilized by the use of chlorine and supplied by the water supply device 42 into the toilet bowl 11 thereby to be used for toilet flushing. Thus, the toilet apparatus can recirculate and reuse part of the flush water.

<Embodiment 2>

Figure 10:
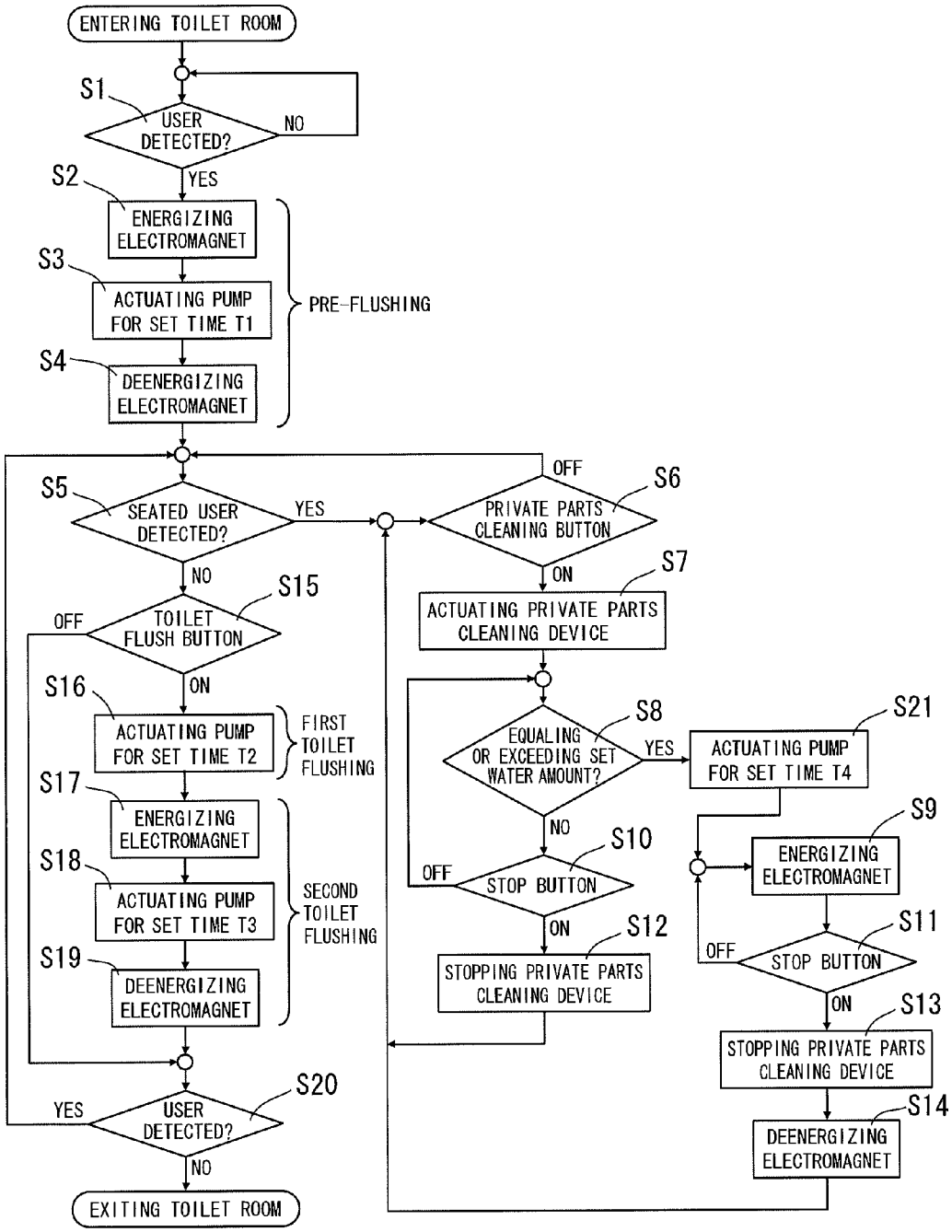
FIG. 10 is a flowchart showing operations of pre-flushing, waste discharge, private parts cleaning and toilet flushing executed by the toilet apparatus according to embodiment 2.

The toilet apparatus according to embodiment 2 differs from embodiment 1 in that when the private parts cleaning water ejected from the cleaning nozzle 51 by actuation of the private parts cleaning device 50 equals or exceeds the set amount in the private parts cleaning operation, the toilet flushing device 40 is actuated to supply a set amount of flush water to the toilet bowl 11 before the private parts cleaning water flowing into the toilet bowl 11 is caused to flow into the drainage channel 30 (step S21), as shown in FIG. 10. The other construction of the toilet apparatus according to embodiment 2 is the same as that of embodiment 1. Identical or similar parts in embodiment 2 are labeled by the same reference symbols as those in embodiment 1 and detailed description of these parts will be eliminated.

In the private parts cleaning operation, when the user presses the private parts cleaning-button 73 of the remote controller 71 (step S6), the private parts cleaning device 50 is actuated (step S7). When an amount of private parts cleaning water ejected from the cleaning nozzle 51 equals or exceeds the set amount, the pump P of the toilet flushing device 40 is actuated for a set time T4 (0.4 sec, for example) to supply the set amount of flush water to the toilet bowl 11 (step S21). Subsequently, the control device 70 energizes the electromagnet 89 to actuate the lock device, whereby the closing tool 85 is locked in the closing state in which the discharge part 20 is closed (step S9).

Thus, in the private parts cleaning operation, the pump P of the toilet flushing device 40 is actuated to supply the set amount of flush water to the toilet bowl 11, before the lock device is actuated to lock the closing tool 85 in the closing state in which the discharge part 20 is closed and the private parts cleaning water flowing into the toilet bowl 11 is caused to flow into the drainage channel 30. Consequently, waste and flush water with a higher impurity degree can completely be discharged into the waste collection tub 90, and the impurity degree of private parts cleaning water flowing into the drainage channel 30 can reliably be reduced.

The first invention, the second invention and the third invention should not be limited by the embodiments described above with reference to the drawings. For example, the technical scope of the present invention includes the following embodiments.

(1) Although the drainage channel has the downstream end communicating with the storage tank so that flush water stored in the storage tank is recirculated and reused for toilet flushing, in embodiments 1 and 2, the downstream end of the drainage channel may communicate with a drainage treatment facility which treats drainage other than the toilet apparatus. In this case, flush water used for toilet flushing may be supplied from a water supply path communicating with a water pipe.

(2) Although the bacterial bed is accommodated in the waste collection tub in embodiments 1 and 2, a waste collection tub of the waste collection type that accommodates no bacterial bed may be used. In this case, too, since an amount of water to be discharged into the waste collection tub can be reduced, the toilet apparatus is effective.

(3) Although flush water is caused to flow into the drainage passage without being discharged into the waste collection tub by locking the discharge part in the closed state by the closing tool, any other configuration may be employed that can cause flush water to flow into the drainage passage without being discharged into the water collection tub.

(4) In embodiments 1 and 2, the pre-flushing is executed in embodiments 1 and 2 when the user present in front of the toilet body is detected by the detecting device. However, the pre-flushing may be executed when the user having been seated on the toilet seat is detected by the seat occupant detecting device.

(5) Although the toilet flushing device can execute the pre-flushing in embodiments 1 and 2, the toilet flushing device may have no pre-flushing function.

(6) Although the private parts cleaning device can execute the nozzle cleaning in embodiments 1 and 2, the private parts cleaning device may have no nozzle cleaning function.

(7) Although the toilet flushing device can execute the cleaning flushing in embodiments 1 and 2, the toilet flushing device may have no cleaning flushing function.

Preferred forms of the fourth invention will be described.

The toilet apparatus may further comprise a connecting device forming the discharge part. The closing tool may be mounted to the connecting device and the air flow path may communicate with a part of the connecting device located above the closing tool. In this case, the toilet apparatus can easily be constructed.

The toilet apparatus may further comprise a drainage channel branched above the closing tool. The air flow path may be connected to the drainage channel. In this case, water flowing into the toilet bowl can be discharged through the drainage channel. Furthermore, odor can be exhausted using the drainage channel and air can be supplied into the toilet bowl using the drainage channel.

The toilet apparatus may further comprise a human body detecting device which is configured to detect presence or absence of a user. The blower may be configured to change a flow rate of air discharged through the toilet bowl and the air flow path, based on the presence or absence of the user detected by the human body detecting device. This case can increase a flow rate of air exhausted through the toilet bowl and the air flow path when the human body detecting device detects the user. Consequently, odor in the toilet room can quickly be exhausted with the result that the user cannot almost feel foul odor. Furthermore, when the human body detecting device does not detect a human body, the flow rate of air the blower exhausts through the toilet bowl and the air flow path can be reduced, whereupon electric power consumption by the blower can be suppressed. Furthermore, in the case where the human body detecting device detects the user, the flow rate of air the blower exhausts through the toilet bowl and the air flow path may be reduced when the air flows along peripheries of the buttocks of the user thereby to cause a discomfort feeling to the user, such as feeling of coolness.

The toilet apparatus may further comprise a temperature detecting device which is configured to detect an ambient temperature around the toilet bowl. The blower may be configured to change a flow rate of air discharged through the toilet bowl and the air flow path, based on the temperature detected by the temperature detecting device. In this case, the flow rate of air the blower exhausts through the toilet bowl and the air flow path is increased when the temperature detected by the temperature detecting device is higher than a set temperature. Consequently, air flowing from the interior of the toilet room into the toilet bowl in summer or the like further flows along peripheries of the buttocks of the user seated on the toilet seat thereby to cause feeling of coolness to the user. Furthermore, when the temperature detected by the temperature detecting device is lower than a set temperature, the flow rate of air the blower exhausts through the toilet bowl and the air flow path is reduced. Consequently, since an amount of air flowing from the interior of the toilet room into the toilet bowl in winter or the like, an amount of air flowing along peripheries of the buttocks of the user seated on the toilet seat can be reduced, whereupon a feeling of coolness can be suppressed.

The blower may be configured to supply air from outside via the air flow path to the toilet bowl when the discharge part is opened by the closing tool. In this case, an air flow is caused from the discharge part toward the waste collection tub when the discharge part is temporarily opened by the closing tool. On this occasion, air supplied from the outside through the air flow path by the actuation of the blower is drawn into the waste collection tub, with the result that air in the toilet bowl is not drawn through the discharge part into the waste collection tub. Consequently, air can be prevented from flowing along peripheries of the buttocks of the user seated on the toilet seat, whereby feeling of coolness caused to the user can be suppressed. Furthermore, odor in the waste collection tub can be prevented from rising above the closing tool.

A flow rate of the air supplied by the blower may be not more than a flow rate of air flowing from the discharge part into the waste collection tub when the discharge part is opened by the closing tool. In this case, air can be prevented from flowing to the toilet bowl side due to the excessively high flow rate of air supplied by the blower. Consequently, the user can be prevented from suffering discomfort.

When the discharge part is closed by the closing tool, the receiving member may be configured to store water on an upper surface thereof while communicating between the toilet bowl and the air flow path. In this case, the water stored on the receiving member can reliably prevent odor in the waste collection tub from rising, and air in the toilet room can be exhausted through the toilet bowl and the air flow path by actuation of the blower.

Embodiments 3 to 6 embodying the toilet apparatus according to the fourth invention will now be described with reference to the drawings.

<Embodiment 3>

Figure 11:
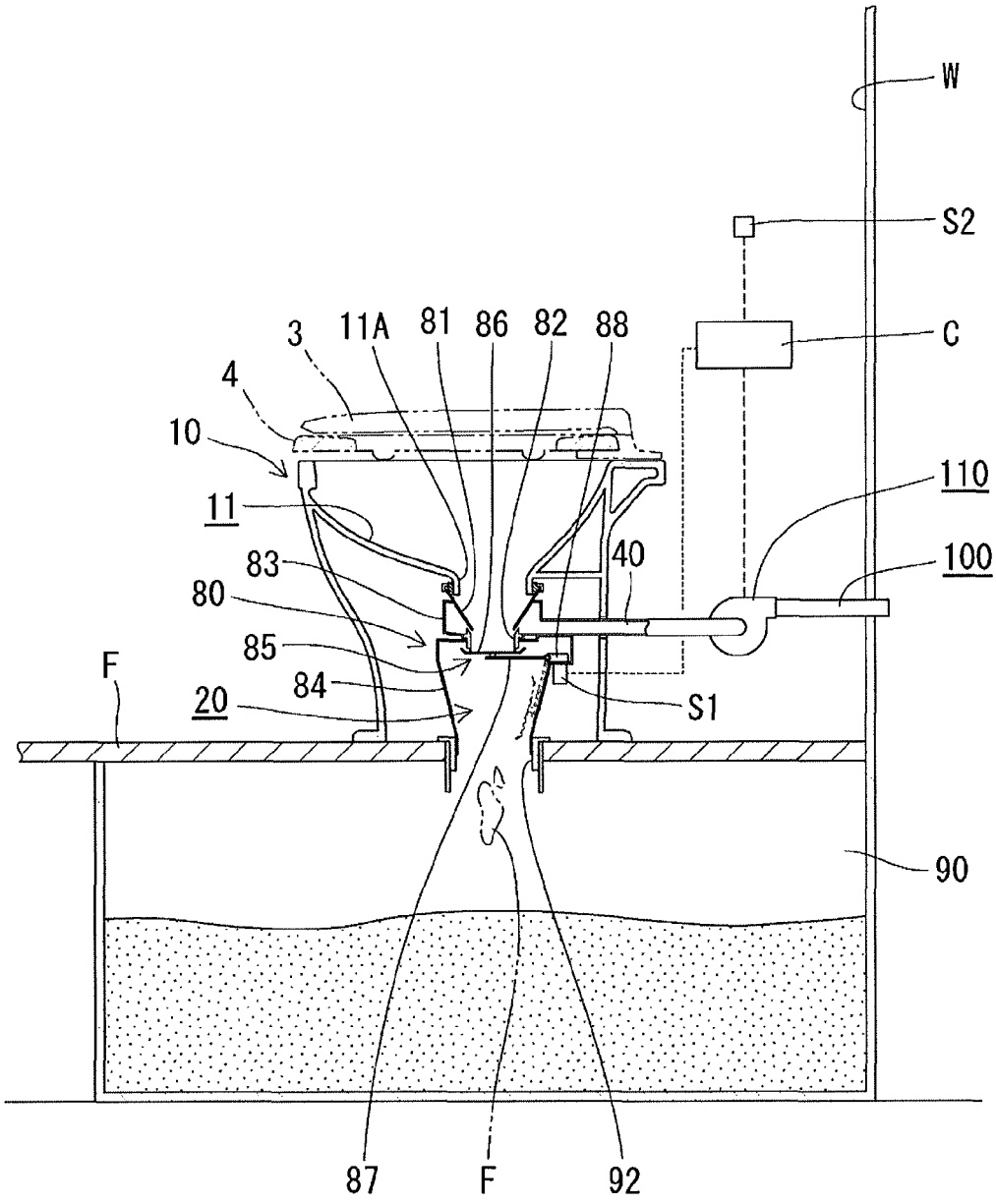
FIG. 11 is a schematic view of the toilet apparatus according to embodiment 3.

The toilet apparatus of embodiment 3 includes the toilet bowl 11, the discharge part 20, the closing tool 85, an air flow path 100 and a fan 110 serving as the blower, as shown in FIG. 11. The toilet bowl 11 is provided in the toilet body 10 and is upwardly open. The toilet bowl 11 has a drain outlet 11A formed through the lowermost end thereof. The toilet body 10 has the toilet cover 3 and the toilet seat 4 both provided above the toilet bowl 11.

The toilet body 10 is installed on a floor surface F in the toilet room. The waste collection tub 90 is provided below the floor surface F. The floor surface F has a through hole 92 located below the drain outlet 11A of the toilet bowl 11. The connecting device 80 which will be described later has a lower end that is inserted into the hole 92 thereby to be connected to the floor. The waste collection tub 90 can store waste F falling through the hole 92.

The connecting device 80 is connected to the drain outlet 11A of the toilet bowl 11. The connecting device 80 forms the discharge part 20 communicating the drain outlet 11A to the waste collection tub 90. The connecting device 80 has a generally conical inlet 81 having an upper end opening connected to an outer peripheral surface of the drain outlet 11A and an open lower end continuous from the upper end opening.

The connecting device 80 has a cylindrical intermediate pipe 82 located lower than the lower end opening of the inlet 81. The intermediate pipe 82 has an inclined surface 82A further having an upper end inclined obliquely upward from an inner peripheral surface toward an outer peripheral surface. An upper end opening edge of the intermediate pipe 82 is located above and outside a lower end opening edge of the inlet 81. A gap is defined between the upper inclined surface of the intermediate pipe 82 and an outer peripheral surface of the lower end of the inlet 81.

The connecting device 80 has a connecting portion 83 connecting between an upper outer surface of the inlet 81 and the outer surface of the intermediate pipe 82. The connecting portion 83 has a cylindrical outer surface. An air flow path 100 is formed so as to outwardly extend from a part of the outer surface of the connecting portion 83. Thus, the air flow path 100 communicates with the vicinity of the upstream side of the closing tool 85 which will be described later, that is, the connecting device 80 located above the closing tool 85. Since the air flow path 100 communicates with the connecting device 80, the toilet apparatus can easily be constructed.

The connecting device 80 has an outlet 84 which is connected to the outer surface of the intermediate pipe 82 and has an open lower end. The outlet 84 is formed into a generally cylindrical shape and has a diameter that is gradually reduced downward. The outlet 84 has a lower end opening connected to a through hole 92 formed through the floor surface F.

The closing tool 85 has a receiving member 86 and a supporting member 87. The receiving member 86 is formed into the shape of a saucer and has a disc-shaped central portion and an edge which is continuous to an outer peripheral edge of the central portion and is inclined obliquely upwardly outward. The supporting member 87 has one end supporting the receiving member 86 and the other end to which a weighting member 88 is connected. The supporting member 87 is rotatably supported on the weighting member 88 side. When the receiving member 86 is moved upward, the upper surface thereof abuts against the lower edge of the intermediate pipe 82, thereby closing the discharge part 20. Furthermore, the weight of the weighting member 88 is set so that the receiving member 86 is lowered to open the discharge part 20 when receiving waste F equaling or exceeding a set weight. When the waste F falls downward from the receiving member 86, the receiving member 86 is moved upward thereby to close the discharge part 20.

The toilet apparatus includes an open/closed state detecting device S1 which detects an open or closed state of the discharge part 20 by the closing tool 85. The open/closed state detecting device S1 transmits a detection signal to the control device C.

The air flow path 100 communicates with the toilet bowl 11 via the connecting portion 83, a gap defined between an inclined surface formed on the upper end of the intermediate pipe 82 and an outer periphery of the lower end of the inlet 81, and the inlet 81, while the discharge part 20 is closed by the closing tool. The air flow path 100 extends through a wall W of the toilet room to the outside. A fan 110 is provided in the middle of the air flow path 100. The fan 110 can change a rotational speed and a rotating direction thereof by respective signals transmitted from the control device C. The fan 110 can change a flow rate of air drawn or supplied by changing the rotational speed thereof. Furthermore, the fan 110 can exhaust air from the connecting device 80 side or can draw outside air to supply it to the connecting device 80 side (the toilet bowl 11 side) by changing the rotating direction thereof.

The toilet apparatus includes a temperature detecting device S2 which detects the temperature in the toilet room where the toilet body 10 having the toilet bowl 11 is installed. The temperature around the toilet body 10 having the toilet body 11 can be detected by the temperature detecting device S2. The temperature detecting device S2 transmits a detection signal to the control device C.

The control device C receives detection signals from the open/closed state detecting device S1 and the temperature detecting device S2. The control device C transmits a control signal to the fan 110 based on the received signals. As a result, the fan 110 is driven as will be described in the following.

When the open/closed state detecting device S1 detects the closed state of the discharge part 20, the control device C controls the fan 110 to draw air from the connecting device 80 side to exhaust the air. As a result, the toilet apparatus can exhaust air in the toilet room through the toilet bowl 11, the connecting device 80 and the air flow path 100 to the outside. In other words, the toilet apparatus can exhaust odor in the toilet room to the outside. Furthermore, the toilet apparatus can also exhaust odor from waste on the receiving member 86 through the connecting device 80 and the air flow path 100 to the outside. Consequently, the user can hardly smell the odor (foul odor) emitted from the waste received on the receiving member and diffusion of the odor in the toilet can be suppressed.

Furthermore, when the toilet room temperature detected by the temperature detecting device S2 is higher than the set temperature, the control device C controls the fan 110 so that the rotational speed of the fan 110 is increased. This increases a flow rate of air exhausted through the toilet bowl 11, the connecting device 80 and the air flow path 100 to the outside. By increasing the flow rate of air flowing from the interior of the toilet room into the toilet bowl 11 in summer or the like, the air flows along peripheries of the buttocks of the user seated on the toilet seat 4 thereby to cause feeling of coolness to the user. Furthermore, when the toilet room temperature detected by the temperature detecting device S2 is lower than the set temperature, the control device C controls the fan 110 so that the rotational speed of the fan 110 is reduced. This reduces the flow rate of air exhausted through the toilet bowl 11, the connecting device 80 and the air flow path 100 to the outside. By reducing the flow rate of air flowing from the interior of the toilet room into the toilet bowl 11 in winter or the like, an amount of air flowing along peripheries of the buttocks of the user seated on the toilet seat can be reduced, whereupon a feeling of coolness can be suppressed.

Furthermore, since the closing tool 85 closes the discharge part 20 when waste falls downward from the receiving member 86, a time period in which the discharge part 20 is opened by the closing tool 85 is short. Accordingly, odor in the waste collection tub 90 rising above the closing tool 85 is small. Thus, since odor rising above the closing tool 85 from the waste collection tub 90 is small, the odor can reliably be exhausted through the air flow path 100 to the outside by driving the fan 110.

Furthermore, the closing tool 85 temporarily opens the discharge part 20 when the weight of waste received by the receiving member 86 is heavier than a set weight. The open/closed state detecting device S1 detects the opening of the discharge part 20, so that the control device C controls the fan 110 to supply outside air through the air flow path 100 to the connecting device 80 side (the toilet bowl 11 side). As a result, the outside air is supplied to the discharge part 20 side, whereby the air is drawn into the waste collection tub 90. This can prevent odor in the tub 90 from rising above the closing tool 85.

Furthermore, when the closing tool 85 temporarily opens the discharge part 20, air flow drawn into the tub 90 causes air to flow along peripheries of the buttocks of the user seated on the toilet seat, sometimes giving feeling of coolness to the user. However, since the fan 110 causes outside air to flow to the connecting device 80 side, the air is drawn into the waste collection tub 90, whereupon air can be prevented from flowing along peripheries of the buttocks of the user seated on the toilet seat. Consequently, the user can be prevented from being given a feeling of coolness.

Accordingly, the user can use the toilet apparatus of embodiment 3 well while having less possibility of smelling foul odor.

<Embodiment 4>

Figure 12:
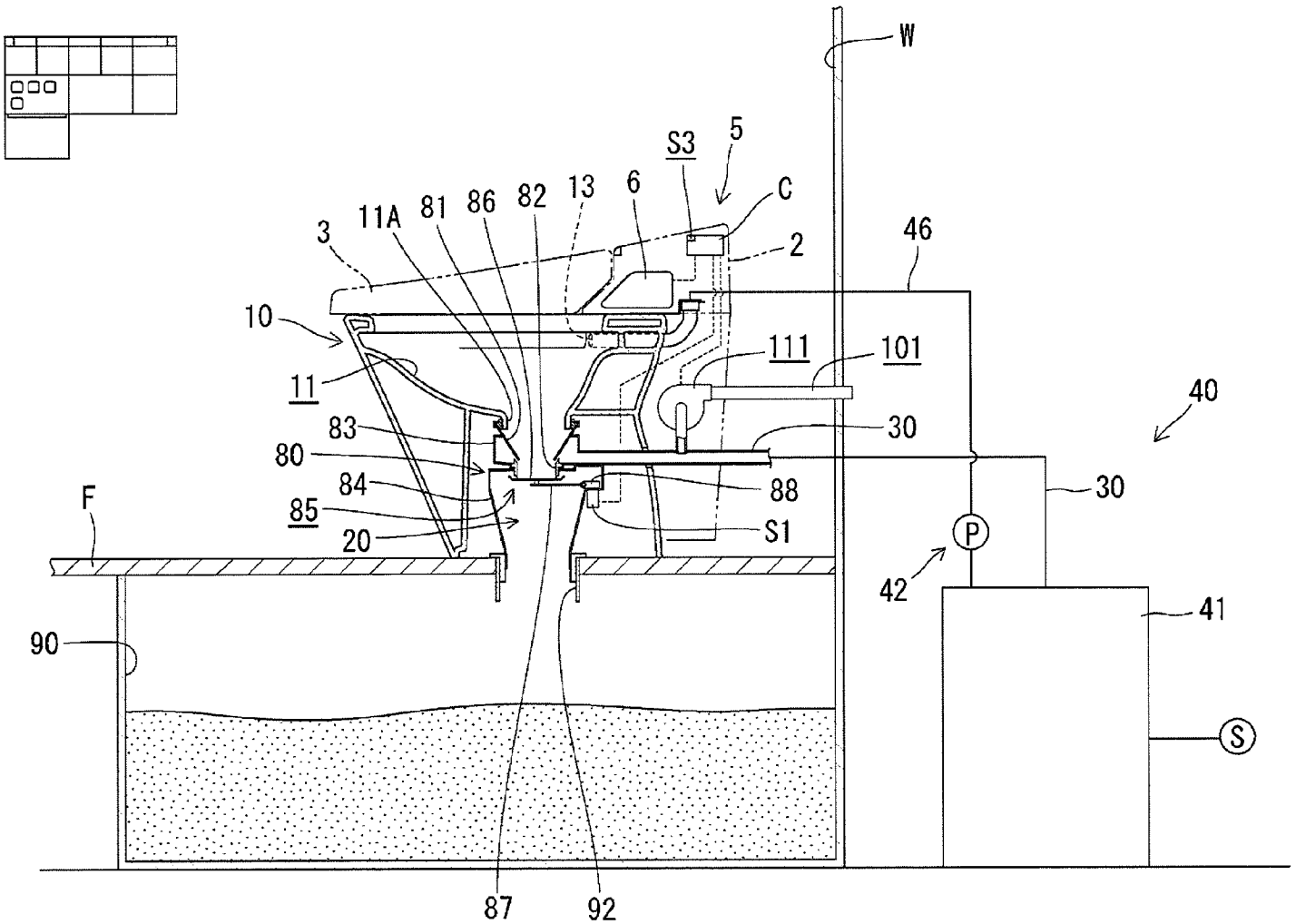
FIG. 12 is a schematic view of the toilet apparatus according to embodiment 4.

The toilet apparatus of embodiment 4 includes the toilet flushing device 40 as shown in FIG. 12. The toilet flushing device 40 includes the drainage channel 30, the storage tank 41 communicating with the downstream side of the drainage channel 30, and the water supply device 42 which supplies flush water stored in the storage tank 41 to the toilet bowl 11. The toilet apparatus further includes a human body detecting device S3 which is configured to detect presence or absence of a user. The toilet apparatus further includes a toilet seat device 5 incorporating a deodorization device 6 in the toilet seat box 2 which rotatably supports the toilet cover 3 and a toilet seat (not shown). In other words, the toilet apparatus includes a toilet device having a deodorizing function. The toilet apparatus still further includes a lock mechanism (not shown) which locks the closing tool 85 in the closing state in which the discharge part 20 is closed. An air flow path 101 communicates with the upstream side of the drainage channel 30. The other configuration of the toilet apparatus of embodiment 4 is the same as that of embodiment 3. Identical or similar parts in embodiment 4 are labeled by the same reference symbols as those in embodiment 3 and detailed description of these parts will be eliminated.

The drainage channel 30 extends from a part of the outer surface of the connecting portion 83 of the connecting device 80. The drainage channel 30 communicates with the storage tank 41 which is installed in the outside so as to extend through the wall surface W of the toilet room.

The water supply device 42 has a water supply conduit 46 provided with a water supply port in a lower interior of the storage tank 41 and a pump P provided in the middle of the water supply conduit 46. The water supply conduit 46 has a downstream end connected to an upstream end of the rim discharge conduit 13. The pump P is actuated so that flush water (reuse of waste water) in the storage tank 41 is supplied via the water supply conduit 46 and the rim discharge pipe 13 into the toilet bowl 11, so that toilet flushing is executed.

The lock mechanism locks the closing tool 85 after the toilet flushing is executed so that toilet paper adherent to the surface of the toilet bowl 11 and waste or the like received on the receiving member 86 have been caused to fall into the waste collection tub 90. Subsequently, toilet flush water received on the receiving member 86 flows into the drainage channel 30 through the gap defined between the inclined surface formed on the upper end of the intermediate pipe 82 of the connecting device 80 and an outer periphery of the lower end of the inlet 81. The toilet flush water having flowed into the drainage channel 30 is stored in the storage tank 41. The storage tank 41 is provided with a filter member and a chlorine sterilizer and stores reused water obtained by purifying the toilet flush water. The storage tank 41 communicates with a water pipe S, whereby tap water can be supplied via the water supply path 1 into the storage tank 41 when the stored reuse water has been reduced.

Upon completion of the toilet flushing, the lock mechanism unlocks the closing tool 85. In this state, the receiving member 86 can receive a set amount (set weight) of toilet flush water on the upper surface thereof. When the set amount of toilet flush water is stored by the receiving member 86, the lower edge of the intermediate pipe 82 goes under the toilet flush water stored on the upper surface of the receiving member 86. As a result, odor in the waste collection tub 90 can reliably be prevented from rising through the discharge part 20.

Furthermore, a water level of the toilet flush water stored on the upper surface of the receiving member 86 is set so as to be lower than the lower end of the inlet 81. Accordingly, the toilet bowl 11 communicates with the air flow path 101 when the discharge part 20 is closed by the closing tool 85. Furthermore, since the air flow path 101 communicates with the drainage channel 30, odor or the like in the toilet room can be exhausted by the use of the drainage channel 30 or outside air can be supplied into the connecting device 80 side (the toilet bowl 11 side) when the fan 111 is driven. The weight of the weighting member 88 is set so that if the water level of the toilet flush water on the upper surface of the receiving member 86 becomes higher than the set water level, the receiving member 86 is lowered and the discharge part 20 is opened so that the toilet flush water falls into the waste collection tub 90. Accordingly, since the water level of the toilet flush water stored on the upper surface of the receiving member 86 does not rise over inlet 81, air in the toilet room can reliably be exhausted through the toilet bowl 11, the connecting device 80, the drainage channel 30 and the air flow path 101 to the outside.

A gap is defined between the upper inclined surface of the upper end of the intermediate pipe 82 and an outer peripheral surface of the lower end of the inlet 81. The gap is formed so as to be no less than 1 mm. As a result, the toilet flush water flowing from the gap into the drainage channel 30 can reliably be prevented from remaining in the gap by surface tension thereby to close the gap.

The human body detecting device S3 can detect the user approaching in front of the toilet body 11. The human body detecting device S3 detects presence or absence of a user and transmits a detection signal to the control device C. The control device C receives the detection signal of the human body detecting device S3 and transmits a control signal to the fan 111 based on the received signal. As a result, the fan 111 is driven as described in the following.

When the human body detecting device S3 detects the user in front of the toilet body 11, the control device C controls the fan 111 so that a rotational speed of the fan 111 is increased. This control manner can increase the flow rate of air exhausted from the toilet room to the outside through the toilet bowl 11, the connecting device 80 and the air flow path 101. Consequently, odor in the toilet room can quickly be exhausted, whereby the user can hardly smell foul odor. Furthermore, when the human body detecting device S3 does not detect the user in front of the toilet body 11, the control device C controls the fan 111 so that a rotational speed of the fan 111 is reduced. This control manner reduces the flow rate of air exhausted from the toilet room to the outside through the toilet bowl 11, the connecting device 80 and the air flow path 101. Furthermore, electrical consumption of the fan 111 can be reduced.

The deodorization device 6 draws air from the interior of the toilet bowl 11 and causes the drawn air to pass through a deodorization agent such as active carbon, thereby eliminating odor and exhausting the deodorized air into the toilet room. When the human body detecting device S3 detects the user in front of the toilet body 11, the control device C controls the deodorization device 6 so that the deodorization device 6 is actuated. Furthermore, when the human body detecting device S3 does not detect the user in front of the toilet body 11, the control device C controls the deodorization device 6 so that the deodorization device 6 is stopped. The control device C can control the fan 111 in tandem with the deodorization device 6. More specifically, when the deodorization device 6 is being driven, the control device C controls the fan 111 so that the fan 111 draws air from the connecting device 80 side and exhausts the air. When the deodorization device 6 is stopped, the control device C controls the fan 111 so that the fan 111 is stopped. Consequently, the user can hardly smell foul odor by the synergy with the deodorization device 6. Furthermore, electrical consumption of the fan 111 can be suppressed.

Accordingly, the user can use the toilet apparatus of embodiment 4 well while having less possibility of smelling foul odor.

<Embodiment 5>

Figure 13:
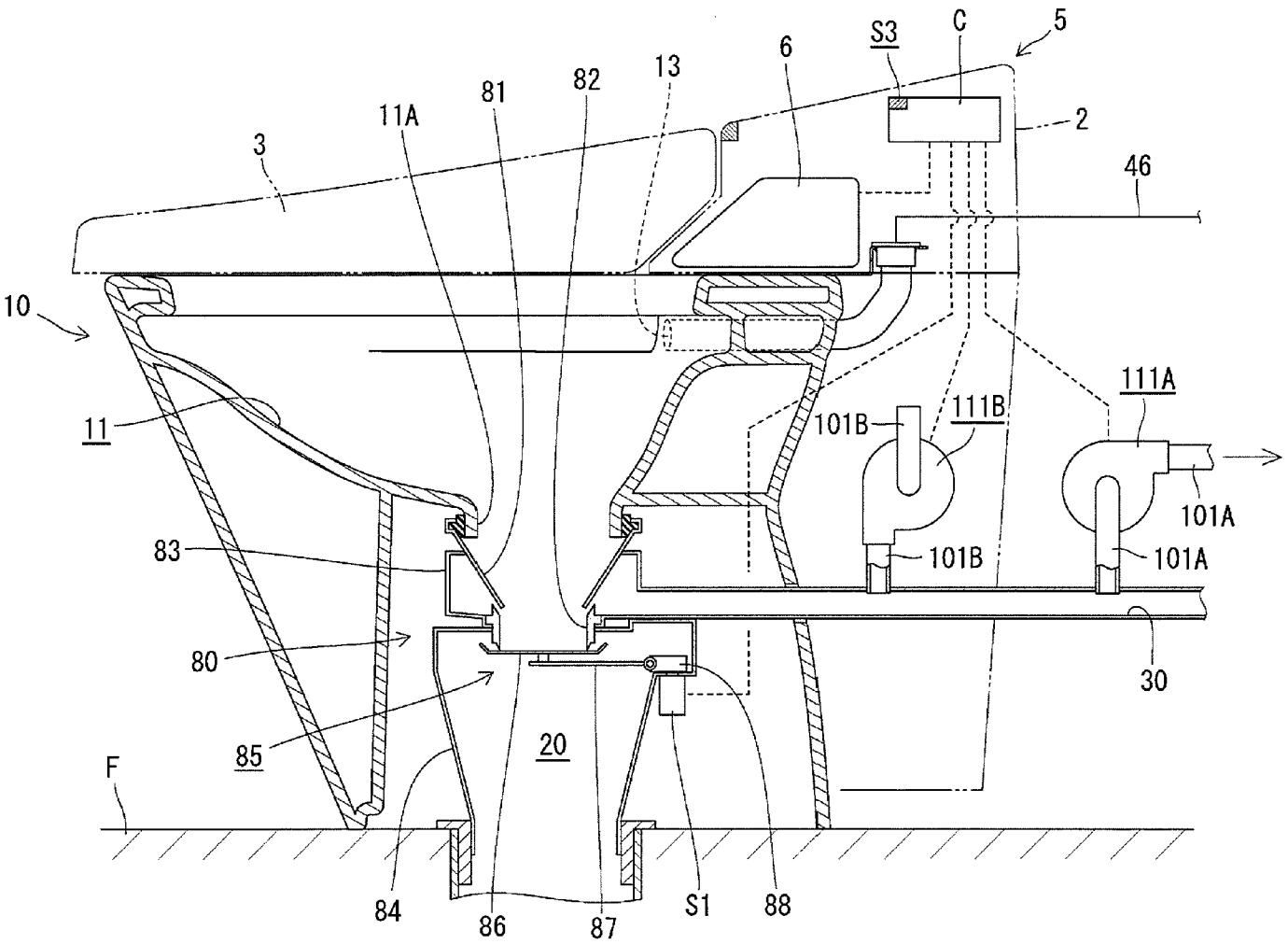
FIG. 13 is a schematic view of a blower in the air discharging state in the toilet apparatus according to embodiment 5.
Figure 14:
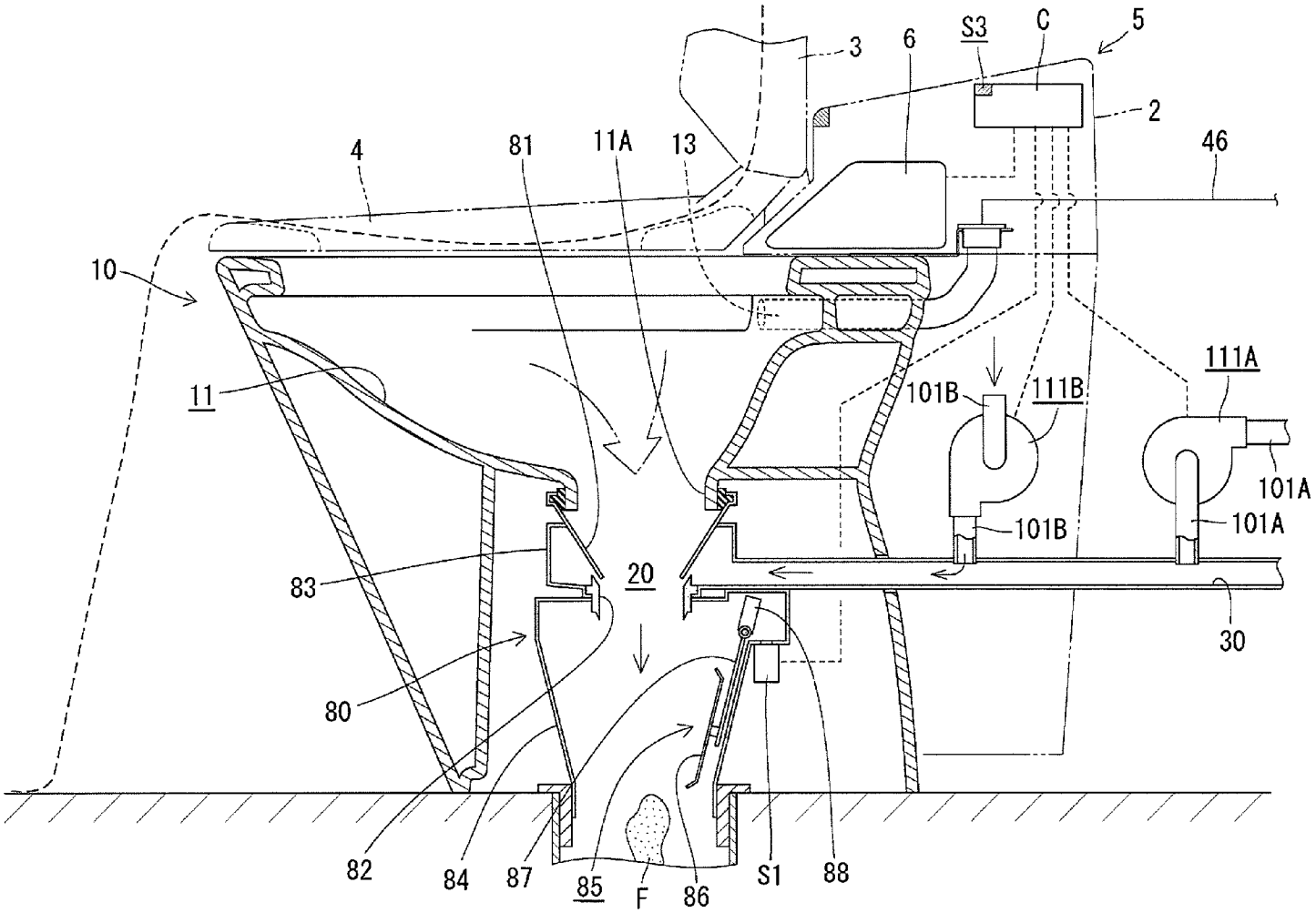
FIG. 14 is a schematic view of a blower in the air supplying state in the toilet apparatus according to embodiment 5.

The toilet apparatus of embodiment 5 includes a first air flow path 101A provided with an exhaust fan 111A and a second air flow path 101B provided with an air supply fan 111B, both fans communicating with the upstream part of the drainage channel 30, as shown in FIGS. 13 and 14. The other construction of the toilet apparatus of embodiment 5 is the same as that of embodiment 4. Identical or similar parts in embodiment 5 are labeled by the same reference symbols as those in embodiment 4 and detailed description of these parts will be eliminated.

The first air flow path 101A extends through the wall of the toilet room to the outside. Accordingly, when driven, the exhaust fan 111A can drawn air from the connecting device 80 side to exhaust the air to the outside. Furthermore, air in the toilet room can be drawn through the second air flow path 101B to be supplied to the connecting device 80 side (the toilet bowl 11 side). Both exhaust and air supply fans 111A and 111B are controlled by the control device C. Since the exhaust and air supply fans 111A and 111B are separately provided, air can strongly be exhausted and supplied. Consequently, the user can use the toilet apparatus of embodiment 5 well while having less possibility of smelling foul odor.

<Embodiment 6>

Figure 15:
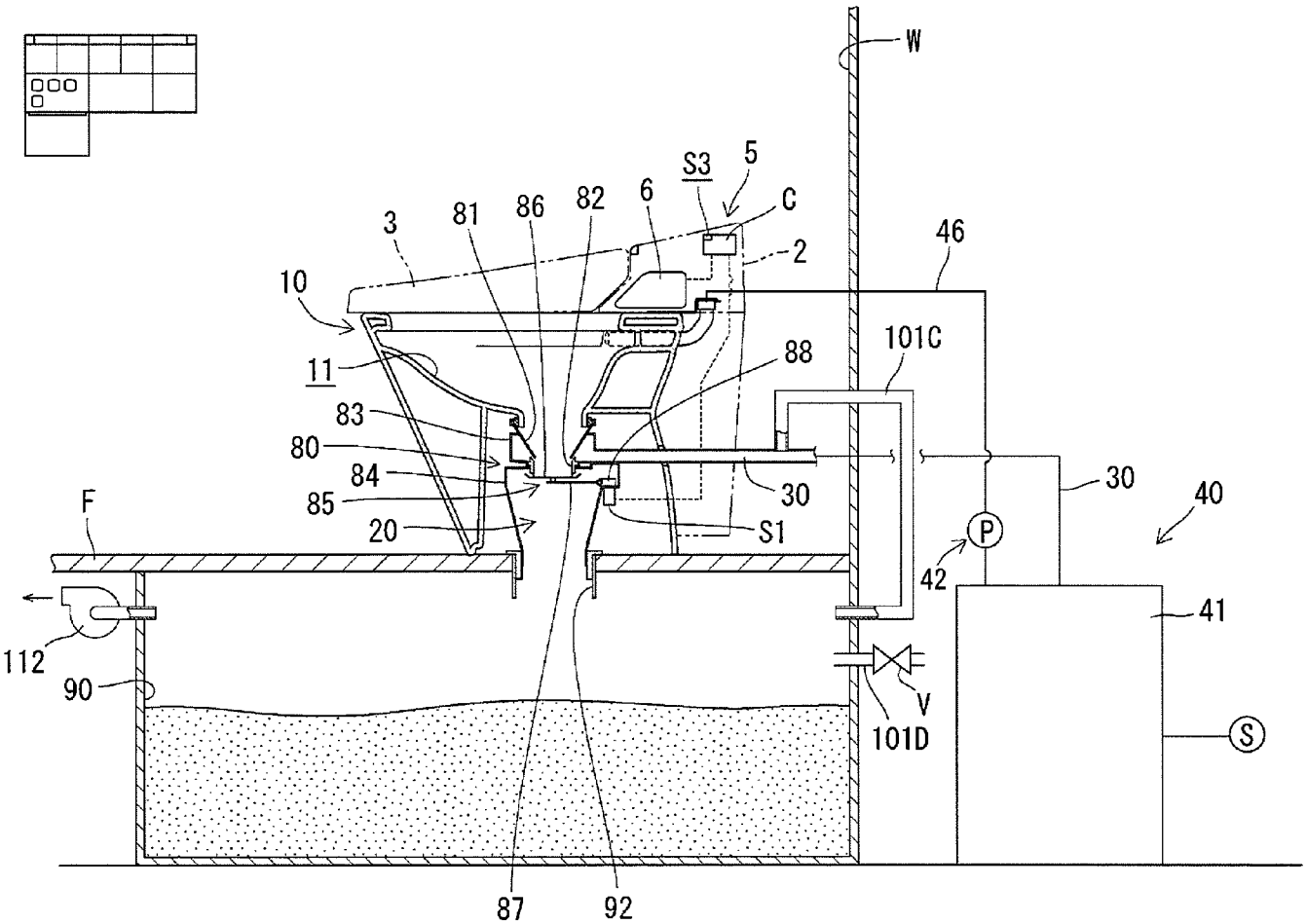
FIG. 15 is a schematic view of the toilet apparatus according to embodiment 6.

The toilet apparatus of embodiment 6 includes a third air flow path 101C communicating between the drainage channel 30 and the waste collection tub 90 as shown in FIG. 15. The toilet apparatus further includes a waste collection tub fan 112 communicating with the waste collection tub 90 and exhausting air in the waste collection tub 90. Furthermore, the waste collection tub 90 has an air flow path 101D having an on-off valve V and communicating with the outside. The other construction of the toilet apparatus of embodiment 6 is the same as that of embodiment 4. Identical or similar parts in embodiment 6 are labeled by the same reference symbols as those in embodiment 4 and detailed description of these parts will be eliminated.

When the waste collection tub fan 112 is driven, air can be drawn from the connecting device 80 side through the waste collection tub 90, the third air flow path 101C communicating with the waste collection tub 90 and the drainage channel 30 to be exhausted. In other words, both odor in the waste collection tub 90 and odor in the toilet room can be exhausted to the outside by drive of the waste collection tub fan 112. Consequently, odor rising from the waste collection tub 90 through the connecting device 80 into the toilet bowl 11 can be reduced. Furthermore, when the rotational speed of the waste collection tub fan 112 is increased to or above a set value, the on-off valve V is opened via the air flow path 101D. In this case, even when the closing tool 85 temporarily opens the discharge part 20 by the falling of waste, air can be prevented from being drawn from the discharge part 20 since air is drawn through the air flow path 101D. Consequently, air can be prevented from flowing along peripheries of the buttocks of the user seated on the toilet seat, thereby preventing from causing feeling of coolness to the user. Accordingly, the user can also use the toilet apparatus well while having less possibility of smelling foul odor.

The present invention should not be limited by the embodiments 3 to 6 described above with reference to the drawings. For example, the technical scope of the present invention includes the following embodiments.

(1) Although the temperature detecting device is provided in embodiment 3, the temperature detecting device may not be provided.

(2) Although each of embodiments 3 to 6 is provided with the open/closed state detecting device which detects the state of the discharge part opened and closed by the closing tool, the open/closed state detecting device may not be provided.

(3) Although the storage tank is provided and the toilet flush water is circulated in each of embodiments 4 to 6, the storage tank may not be provided and the toilet flush water may not be circulated. In this case, urine and toilet flush water flowing into the drainage channel is desirably treated in a water-purifier tank or the like thereby to be released.

(4) Although the human body detecting device is provided in each of embodiments 4 to 6, the human body detecting device may not be provided.

(5) Although the fan is driven in tandem with the deodorizing device in each of embodiments 4 to 6, the fan may not be driven in tandem with the deodorizing device.

(6) Although air is supplied from the outside through the air flow path to the connecting device side (the toilet bowl side) in each of embodiments 3 to 5 when the discharge part has been opened by the closing tool, the air may not be supplied.

(7) The air supply fan shown in embodiment 3 may be provided in the third air flow path in embodiment 6.

(8) Although the discharge part is opened by the closing tool when the receiving member receives waste or the like whose amount equals or exceeds the set weight in each of embodiments 3 to 6, the user may operate the discharge part thereby to open it.

(9) Although the weighting member is set in embodiment 4 so that the water level of the toilet flush water received on the upper surface of the receiving member is located lower than the lower end of the inlet, the water level may be detected by a water level sensor or the like and the closing tool may be forced to be actuated when a set water level is reached, whereby the discharge part may be opened.

(10) In embodiment 4, an operation section for a deodorizing operation may be provided so that the operation section is operated for adjustment of the rotational speed of the fan.

EXPLANATION OF REFERENCE SYMBOLS

10 . . . toilet body toilet bowl
11A . . . drain outlet
20 . . . discharge part
30 . . . drainage channel
40 . . . toilet flushing device
41 . . . storage tank
42 . . . water supply device
50 . . . private parts cleaning device
51 . . . cleaning nozzle
60 . . . detecting device
70 . . . control device
80 . . . connecting device
85 . . . closing tool
86 . . . receiving member
89 . . . electromagnet (lock device)
90 . . . waste collection tub
100, 101, 101A, 101B, 101C . . . air flow path (101A . . . first air flow path, 101B . . . second air flow path, 101C . . . third air flow path)
110, 111, 111A, 111B, 112 . . . fan (blower) (111A . . . exhaust fan, 111B . . . air supply fan, 112 . . . waste collection tub fan)
S2 . . . temperature detecting device
S3 . . . human body detecting device

The invention claimed is:

1. A toilet apparatus which comprises:

a toilet body provided with a toilet bowl having a drain outlet in a lower part thereof;

a discharge part communicating between the drain outlet and a waste collection tub provided below the toilet body;

a drainage channel branched off from the discharge part; and a private parts cleaning device assembled to the toilet body and having a cleaning nozzle, wherein when the private parts cleaning device is actuated and an amount of cleaning water ejected from the cleaning nozzle equals or exceeds a set amount, the cleaning water flowing into the toilet bowl is caused to flow into the drainage channel without being discharged via the discharge part into the waste collection tub.

2. The toilet apparatus according to claim 1, further comprising a toilet flushing device supplying flush water into the toilet bowl, wherein when the private parts cleaning device is actuated and an amount of cleaning water ejected from the cleaning nozzle equals or exceeds the set amount, the toilet flushing device is actuated before the cleaning water flowing into the toilet bowl is caused to flow into the drainage channel, so that a predetermined amount of flush water is supplied into the toilet bowl.

3. The toilet apparatus according to claim 1, wherein the discharge part is connected to the drain outlet, the apparatus further comprising:

a connecting device including a closing tool which opens and closes the discharge part and a lock device which locks the closing tool in a closing state in which the discharge part is closed, the drainage channel being formed by branching the discharge part at an upstream side with respect to the closing tool; and a control device which actuates the lock device so that the closing tool is locked in the closing state when the private parts cleaning device is actuated and the amount of cleaning water ejected from the cleaning nozzle equals or exceeds the set amount.

4. The toilet apparatus according to claim 3, further comprising:

a toilet flushing device supplying flush water into the toilet bowl; and a control device which actuates the toilet flushing device to supply a predetermined amount of flush water into the toilet bowl before actuating the lock device so that the closing tool is locked in the closing state when the private parts cleaning device is actuated and an amount of cleaning water ejected from the cleaning nozzle equals or exceeds the set amount.

5. A toilet apparatus comprising:

a toilet body provided with a toilet bowl having a drain outlet in a lower part thereof;

a discharge part communicating between the drain outlet and a waste collection tub provided below the toilet body;

a drainage channel branched off from the discharge part; and a private parts cleaning device assembled to the toilet body and having a cleaning nozzle and a nozzle cleaning mechanism, wherein nozzle cleaning water having flowed into the toilet bowl is caused to flow into the drainage channel without being discharged via the discharge part into the waste collection tub, while the cleaning nozzle is being cleaned by the nozzle cleaning mechanism.

6. The toilet apparatus according to claim 5, wherein the discharge part is connected to the drain outlet, the apparatus further comprising:

a connecting device including a closing tool which opens and closes the discharge part and a lock device which locks the closing tool in a closing state in which the discharge part is closed, the drainage channel being formed by branching the discharge part at an upstream side with respect to the closing tool; and a control device which actuates the lock device so that the closing tool is locked in the closing state, while the cleaning nozzle is being cleaned by the nozzle cleaning mechanism.

7. The toilet apparatus according to claim 1, further comprising a second control device which prevents actuation of the toilet flushing device supplying flush water into the toilet bowl, while the private parts cleaning device is being actuated.

8. A toilet apparatus which comprises a toilet body provided with a toilet bowl having a drain outlet in a lower part thereof;

a discharge part communicating between the drain outlet and a waste collection tub provided below the toilet body;

a drainage channel branched off from the discharge part; and a toilet flushing device which executes cleaning flushing in which a set amount of flush water is supplied into the toilet bowl when the toilet body is cleaned, wherein the flush water flowing into the toilet bowl is caused to flow into the drainage channel without being discharged via the discharge part into the waste collection tub, during execution of the cleaning flushing.

9. The toilet apparatus according to claim 8, wherein the discharge part is connected to the drain outlet, the apparatus further comprising:

a connecting device including a closing tool which opens and closes the discharge part and a lock device which locks the closing tool in a closing state in which the discharge part is closed, the drainage channel being formed by branching the discharge part at an upstream side with respect to the closing tool; and a control device which actuates the lock device during execution of the cleaning flushing so that the closing tool is locked in the closing state.

10. The toilet apparatus according to claim 1, wherein the toilet flushing device includes a storage tank communicating with a downstream side with respect to the drainage channel and a water supply device supplying flush water stored in the storage tank into the toilet bowl.

11. A toilet apparatus comprising:

a toilet bowl;

a discharge part communicating between the toilet bowl and a waste collection tub provided below the toilet bowl;

a closing tool having a receiving member which receives egested waste and/or water flowing into the toilet bowl, the closing tool closing the discharge part when the waste and/or the water has fallen from the receiving member;

an air flow path communicating with a vicinity of an upstream side with respect to the closing tool while the discharge part is closed by the closing tool; and a blower provided in the air flow path, and wherein the blower is configured to supply air from outside via the air flow path to the toilet bowl when the discharge part is opened by the closing tool.

12. The toilet apparatus according to claim 11, further comprising a connecting device forming the discharge part, wherein the closing tool is mounted to the connecting device and the air flow path communicates with a part of the connecting device located above the closing tool.

13. The toilet apparatus according to claim 11, further comprising a drainage channel branched above the closing tool, wherein the air flow path is connected to the drainage channel.

14. The toilet apparatus according to claim 11, further comprising a human body detecting device which is configured to detect presence or absence of a user, and wherein said blower or a second blower is configured to change a flow rate of air discharged through the toilet bowl and the air flow path, based on the presence or absence of the user detected by the human body detecting device.

15. The toilet apparatus according to claim 11, further comprising a temperature detecting device which is configured to detect an ambient temperature around the toilet bowl, and wherein said blower or a second blower is configured to change a flow rate of air discharged through the toilet bowl and the air flow path, based on the temperature detected by the temperature detecting device.

16. The toilet apparatus according to claim 11, wherein a flow rate of the air supplied by the blower is not more than a flow rate of air flowing from the discharge part into the waste collection tub when the discharge part is opened by the closing tool.

17. The toilet apparatus according to claim 11, wherein when the discharge part is closed by the closing tool, the receiving member is configured to store water on an upper surface thereof while communicating between the toilet bowl and the air flow path.

18. The toilet apparatus according to claim 5, further comprising a second control device which prevents actuation of the toilet flushing device supplying flush water into the toilet bowl, while the private parts cleaning device is being actuated.

19. The toilet apparatus according to claim 5, wherein the toilet flushing device includes a storage tank communicating with a downstream side with respect to the drainage channel and a water supply device supplying flush water stored in the storage tank into the toilet bowl.

20. The toilet apparatus according to claim 8, wherein the toilet flushing device includes a storage tank communicating with a downstream side with respect to the drainage channel and a water supply device supplying flush water stored in the storage tank into the toilet bowl.

21. The toilet apparatus according to claim 11, wherein said blower is configured to both supply air to and discharge air from the toilet bowl.

* * * * *